US005395462A

United States Patent [19]

Takeshita et al.

[11] Patent Number: 5,395,462

[45] Date of Patent: * Mar. 7, 1995

[54] ANISOTROPIC RARE EARTH-FE-B SYSTEM AND RARE EARTH-FE-CO-B SYSTEM MAGNET

[75] Inventors: Takuo Takeshita; Ryoji Nakayama; Tamotsu Ogawa, all of Omiya, Japan

[73] Assignee: Mitsubishi Materials Corporation, Tokyo, Japan

[ * ] Notice: The portion of the term of this patent subsequent to Jul. 20, 2010 has been disclaimed.

[21] Appl. No.: 21,187

[22] Filed: Feb. 23, 1993

Related U.S. Application Data

[63] Continuation of Ser. No. 927,481, Sep. 28, 1992, abandoned.

[30] Foreign Application Priority Data

| | | | |
|---|---|---|---|
| Jan. 28, 1991 | [JP] | Japan | 3-60828 |
| Jan. 30, 1991 | [JP] | Japan | 3-60833 |
| Jan. 31, 1991 | [JP] | Japan | 3-60837 |
| Feb. 1, 1991 | [JP] | Japan | 3-60860 |

[51] Int. Cl.[6] ..... H01F 1/04

[52] U.S. Cl. ..... 148/302; 75/244

[58] Field of Search ..... 148/302; 420/83, 121; 75/244

[56] References Cited

U.S. PATENT DOCUMENTS

| | | | |
|---|---|---|---|
| 4,981,532 | 1/1991 | Takeshita et al. | 148/302 |
| 5,228,930 | 7/1993 | Nakayama et al. | 148/302 |

FOREIGN PATENT DOCUMENTS 274034 7/1988 European Pat. Off. .

OTHER PUBLICATIONS

Patent Abstracts of Japan, vol. 12, No. 500 Dec. 27, 1988 & JP-63 211 706 Sep. 2, 1988.

R. K. Mishra, Journal of Applied Physics, vol. 61, No. 8, Apr. 15, 1987, p. 3778, paragraph 2.

Patent Abstracts of Japan, vol. 14, No. 12 Jan. 11, 1989 & JP-12 57 308 Oct. 13, 1989.

Patent Abstracts of Japan, vol. 13, No. 292 Jul. 6, 1989 & JP-10 73 602 Mar. 17, 1989.

*Primary Examiner*—John P. Sheehan

*Attorney, Agent, or Firm*—Scully, Scott, Murphy & Presser

[57] ABSTRACT

A hot press molded body or an HIP molded body having one of a composition comprising R: 10–20 atomic %, B: 3–20 atomic %, and a total amount of one or a plurality of Ga, Zr, and Hf: 0.001–5.0 atomic %, a remainder comprising Fe and unavoidable impurities; or a composition comprising R: 10–20 atomic %, B: 3–20 atomic %, and a total amount of one or a plurality of Ti, V, Nb, Ta, Al, and Si: 0.001–5.0 atomic %, a remainder comprising Fe and unavoidable impurities; or a composition comprising Co: 0.1–50 atomic % added to one of the above compositions, having an aggregate structure of crystallized grains having as a main phase thereof a $R_2Fe_{14}B$ type or $R_2(Fe, Co)_{14}B$ type intermetallic compound having a tetragonal structure, the crystallized grains having dimensions of 0.05–20 μm; and individual crystallized grains comprising more than 50 volume % of the total crystallized grains comprising the aggregate structure, have a value of less than 2 of a ratio b/a of a smallest grain diameter a and a largest grain diameter b.

10 Claims, No Drawings

ANISOTROPIC RARE EARTH-FE-B SYSTEM AND RARE EARTH-FE-CO-B SYSTEM MAGNET

CROSS-REFERENCE TO RELATED APPLICATIONS

This application is a continuation of application Ser. No. 07/927,481, filed on Sep. 28, 1992, of Takeshita, et al now abandoned.

FIELD OF THE INVENTION

The present invention relates to a R (where R represents at least one type of rare earth element including Y)—Fe—B system and a R—Fe—Co—B system anisotropic magnet possessing superior magnetic anisotropy and a small coercive force temperature coefficient, and relates more particularly to an anisotropic magnet comprising a hot press molded body or a hot isostatic press molded body.

PRIOR ART

In Japanese Patent Application, First Publication, Laid-Open no. Hei 1-132106, a R—Fe—B system permanent magnetic powder obtained by means of the hydrogen treatment of a R—Fe—B system mother alloy, and a R—Fe—Co—B system permanent magnetic powder obtained by the hydrogen treatment of a R—Fe—Co—B system mother alloy, are disclosed.

The above R—Fe—B system permanent magnetic powder utilizes R—Fe—B system mother alloy as a raw material for the main phase of a $R_2Fe_{14}B$ type intermetallic compound phase (hereinbelow termed the "$R_2Fe_{14}B$ type phase") which is a ferromagnetic phase; after the heat treatment of this mother alloy raw material in a $H_2$ atmosphere within a specified temperature range and the fostering of a phase-changed state in each of the $RH_x$, $Fe_2B$, and the remaining Fe phases, the $H_2$ is removed from the raw material by means of an $H_2$-desorption process, and the $R_2Fe_{14}B$ type phase, which is the ferromagnetic phase, is recreated; the $R_2Fe_{14}B$ system permanent magnetic powder obtained as a result has an aggregate structure such that the main phase thereof is an extremely fine $R_2Fe_{14}B$ type phase having a recrystallized structure and an average grain diameter of 0.05–3 μm.

Furthermore, in the same manner, the above R—Fe—Co—B system permanent magnetic powder uses R—Fe—Co—B system mother alloy having as a main phase thereof $R_2(Fe, Co)_{14}B$ type intermetallic compound (hereinbelow termed $R_2(Fe, Co)_{14}B$ type phase), which is a ferromagnetic phase, as a raw material thereof, and this is processed in a manner identical to the case of the above R—Fe—B system; this has an aggregate structure having as a main phase thereof an extremely fine $R_2(Fe, Co)_{14}B$ type phase with a recrystallized structure and an average grain diameter of 0.05–3 μm.

The above R—Fe—B system and R—Fe—Co—B system permanent magnetic powders are unable to achieve sufficient magnetic anisotropy simply as a result of being formed as hot press molded bodies, so that, as disclosed in Japanese Patent Application, First Publication, Laid-Open No. Hei 2-39503, by carrying out a hot rolling process such as hot rolling or the like on the above hot press molded bodies and thus creating a rolled structure, the C axes of the crystal grains of the $R_2Fe_{14}B$ phase or the $R_2(Fe, Co)_{14}B$ type phase are oriented, and the magnetic anisotropy thereof is increased.

However, R—Fe—B system and R—Fe—Co—B system rolled magnets obtained by the further hot rolling of a hot press molded body possess superior magnetic anisotropy; but in comparison with magnets which are produced by the hot pressing of the above R—Fe—B system and R—Fe—Co—B system permanent magnetic powders obtained by means of hydrogen treatment, the temperature coefficient of the coercive force increases in an undesirable manner, and in the case in which such a rolled magnet is incorporated in a motor or the like, the performance of such a motor or the like varies based on temperature, and there is a problem in that the stability thereof is lacking.

Furthermore, in the above R—Fe—B system and R—Fe—Co—B system rolled magnets, positional variation in the degree of working causes variations in magnetic anisotropy, so that in order to prevent this, it is impossible to avoid an increase in the complexity of the hot plastic working processes.

Believing that the above increase in the temperature coefficient of the coercive force was caused as a result of the hot rolling of a hot press molded body, and based on the conviction that if a magnet having superior magnetic anisotropy could be obtained without the use of hot rolling, this increase in the temperature coefficient of the coercive force would not occur, the present inventors have conducted research, and have obtained the R—Fe—B system and R—Fe—Co—B system anisotropic magnets of the present invention.

DETAILED DESCRIPTION OF THE INVENTION

The first anisotropic magnet in accordance with the present invention is a R—Fe—B system anisotropic magnet which is a hot press molded body or a hot isostatic press molded body (hereinafter termed an "HIP molded body") having a composition comprising 10–20 atomic % of R, 3–20 atomic % of B, and 0.001–5.0 atomic % of one or the total amount of a plurality of Ga, Zr, and Hf, the remainder comprising Fe and unavoidable impurities; the above hot press molded body or HIP molded body has an aggregate structure of crystal grains having dimensions such that the average grain diameter is 0.05–20 μm and having as a main phase thereof a $R_2Fe_{14}B$ type intermetallic compound with a tetragonal structure; in addition, 50 volume % or more of the total individual crystal grains comprising the above aggregate structure have a value of less than 2 for b/a, a for the smallest grain diameter and b for the largest grain diameter.

This first anisotropic magnet has a small coercive force temperature coefficient, does not exhibit the localized variations in magnetic anisotropy when compared with conventional molded magnets, and also possesses superior corrosion resistance.

Furthermore, as this first R—Fe—B system anisotropic magnet possesses a crystal grain aggregate structure, it possesses superior magnetic anisotropy and a high coercive force in the vicinity of a $R_2Fe_{14}B$ type compound composition, that is to say, in the vicinity of a $R_{11.8}Fe_{bal}B_{5.9}$ (atomic %) composition.

It is acceptable to add, to the first R—Fe—B system anisotropic magnet composition, one or a plurality of a group comprising Al, V, and Si, in a total amount of 0.01–2.0 atomic %. In such a case, the maximum energy product is further increased, more striking magnetic anisotropy is displayed, and the coercive force temperature coefficient is also small.

Next, a manufacturing method for the above R—Fe—B system anisotropic magnet will be explained. First, a R—Fe—B system mother alloy having a fixed component composition containing Ga, Zr, and Hf, or a R—Fe—B system mother alloy comprising a fixed component composition containing Al, V, and Si, in addition to this alloy, is manufactured.

Next, the above R—Fe—B system mother alloy is heated in an atmosphere of hydrogen gas, and is subjected to heat processing at a temperature of 500°-1000° C. in an atmosphere of hydrogen gas or a mixed atmosphere of hydrogen gas and an inert gas; next, hydrogen desorped processing is conducted at a temperature of 500°-1000° C. so as to create a vacuum atmosphere in which the hydrogen gas pressure is below a level of 1 Torr or to create an inert gas atmosphere in which the hydrogen gas partial pressure is less than 1 Torr, this is cooled, and thereby a R—Fe—B system permanent magnetic powder possessing superior magnetic anisotropy and resistance to corrosion is obtained.

By adding a homogenizing processing procedure in which the above R—Fe—B system mother alloy is homogenized at a temperature of 600°-1200° C. prior to the conducting of the above heat treatment, and by adding a heat processing procedure in which heat processing is conducted at a temperature of 300°-1000° C., after the above hydrogen desorped processing, it is possible to manufacture a R—Fe—B system permanent magnetic powder having even more superior magnetic anisotropy and corrosion resistance. The structure of the R—Fe—B system permanent magnetic powder manufactured in the above manner comprises a recrystallized aggregate structure in which recrystallized grains of a $R_2Fe_{14}B$ type intermetallic compound phase which are free of impurities and strains within the grains or at grain boundaries, are aggregated. It is sufficient if the average crystallized grain diameter of the recrystallized grains comprising the recrystallized aggregate structure is within a range of 0.05-20 μm; however, a range of 0.05-3 μm, which is close to the dimensions of the simple magnetic domain grain diameter (approximately 0.3 μm) is more preferable.

It is preferable that the individual recrystallized grains having the above dimensions have a value of less than 2 for the ratio b/a, the ratio between the smallest grain diameter a and the largest grain diameter b; it is necessary that recrystallized grains having this form be present in an amount greater than 50 volume % of the total recrystallized grains comprising the powder. By means of using recrystallized grains having a shape such that the ratio b/a of the smallest grain diameter a and the largest grain diameter b is less than 2, the coercive force of the R—Fe—B system permanent magnetic powder is improved, and the temperature coefficient αiHc of the coercive force within the temperature range of 25°-100° C. becomes smaller than −0.6%/°C.

Next, by pressing the above R—Fe—B system permanent magnetic powder to a green compact in a magnetic field and then subjecting this green compact to hot pressing or an HIP process at a temperature of 600° C.-900° C., it is possible to produce a R—Fe—B system anisotropic magnet which preserves the superior characteristics of the above R—Fe—B system permanent magnetic powder. Furthermore, after conducting hot pressing or an HIP process, by conducting, where necessary, heat processing at a temperature of 300° C.-1000° C. it is possible to improve the coercive force.

When the above green compact is sintered by means of a normal sintering method, as the sintering temperature is, in general, high, the superfine recrystallized grains of the R—Fe—B system permanent magnetic powder grow to large crystallized grains, and as the magnetic characteristics, and in particular the coercive force, worsen, such a method is not preferred. Accordingly, it is not preferable to utilize a normal sintering method as a method for the manufacture of the R—Fe—B system anisotropic magnets of the present invention; it is necessary, rather, to utilize a hot press method or a HIP method which enables sintering at comparatively low temperatures, and thus to control the growth of crystallized grains. Furthermore, as the imparting of magnetic anisotropy is conducted in a magnetic field, there is no necessity to conduct a thermoplastic process after hot pressing or the HIP process.

The reasons for the limitation of the component composition, average crystallized grain diameter, and crystallized grain form of the first R—Fe—B system anisotropic magnet are as follows.

(a) R

R exhibits one or a plurality of Nd, Pr, Tb, Dy, La, Ce, Ho, Er, Eu, Sm, Gd, Tm, Yb, Lu, and Y; in general, Nd is used as a main element, and to this are added other rare earth elements, and in particular, Tb, Dy, and Pr have the effect of increasing the coercive force iHc. If the amount of R contained is less than 10 atomic %, or if this amount is greater than 20 atomic %, the coercive force of the anisotropic magnet is reduced, and superior magnetic characteristics cannot be obtained. Accordingly, the amount of R contained is set at a level of 10-20 atomic %.

(b) B

If the amount of B contained is less than 3 atomic %, or if this amount is greater than 20 atomic %, the coercive force of the anisotropic magnet is reduced, and superior magnetic characteristics cannot be obtained, so that the amount of B contained is set at a level of 3-20 atomic %. It is possible to substitute one or a plurality of C, N, O, P, and F for a portion of B; this is also the case with the second-fourth anisotropic magnets described hereinafter.

(c) Ga, Zr, and Hf

Ga, Zr, and Hf have the function of increasing the coercive force and also stably imparting superior magnetic anisotropy and resistance to corrosion; however, if one or a plurality of Ga, Zr, and Hf are contained in a total amount of less than 0.001 atomic %, the desired effects cannot be obtained, while on the other hand, when the total amount contained is greater than 5.0 atomic %, the magnetic characteristics worsen. Accordingly, the total amount contained of 1 or a plurality of Ga, Zr, and Hf is set to a level of 0.001-5.0 atomic %.

(d) Al, V, and Si

Where necessary, Al, V, and Si may be added as components of the R—Fe—B system anisotropic magnet. These exhibit the effect of increasing the coercive force; however, if one or a plurality of Al, V, and Si are contained in a total amount of less than 0.01 atomic %, the desired effects cannot be obtained, while on the other hand, when this amount exceeds 2.0 atomic %, the magnetic characteristics worsen. Accordingly, it is preferable that one or a plurality of Al, V, and Si be contained in a total amount of 0.01-2.0 atomic %.

(e) Average Crystallized Grain Diameter and Form Thereof

If the average crystallized grain diameter of the crystallized grains comprising the structure of the anisotropic magnet is smaller than 0.05 μm, magnetization becomes a problem, so that this is not desirable, while on the other hand, at a value of more than 20 μm, the coercive force and the angularity of the hysteresis loop is reduced, and furthermore, the temperature coefficient of the coercive force increases, so that this is also not desirable. Accordingly, the average crystallized grain diameter is set to a value of 0.05–20 μm. It is more preferable that the average crystallized grain diameter be within the range of 0.05–3 μm, which is close to the dimensions of the simple magnetic domain grain diameter (0.3 μm). It is preferable that the individual crystallized grains have a value of less than 2 for the ratio b/a, the ratio of the smallest grain diameter a and the largest grain diameter b; it is necessary that crystallized grains having such a form be present in an amount of greater than 50 volume % of the total crystallized grains. By means of so setting the form of the crystallized grains so that a value of less than 2 is obtained for the ratio b/a between the smallest grain diameter a and the largest grain diameter b, the coercive force of the R—Fe—B system anisotropic magnet is improved, the resistance to corrosion increases, and the temperature coefficient of the coercive force is reduced. Accordingly, the value of b/a of the individual crystallized grains is set to less than 2.

The second anisotropic magnet in accordance with the present invention is a R—Fe—B system anisotropic magnet which is a hot press molded body or a HIP molded body having a composition comprising 10–20 atomic % of R, 3–20 atomic % of B, and one or a plurality of Ti, V, Nb, Ta, Al, and Si in a total amount of 0.001–5.0 atomic %, wherein the remainder comprises Fe or unavoidable impurities; the hot press molded body or HIP molded body above has an aggregate structure of crystallized grains having as a main phase thereof an $R_2Fe_{14}B$ type intermetallic compound with a tetragonal structure, the crystallized grains having an average grain diameter of 0.05–20 μm, and 50 volume % or more of the individual crystallized grains forming the above aggregate structure have a ratio b/a of the smallest grain diameter a and the largest grain diameter b having a value of less than 2. In this second R—Fe—B system anisotropic magnet, as well, superior effects which are identical to those of the above first anisotropic magnet can be obtained.

In manufacturing this second anisotropic magnet, first, a R—Fe—B system mother alloy having a fixed component composition Containing one or a plurality of Ti, V, Nb, Ta, Al, and Si is subjected to melt casting, and it is then acceptable, using this as a raw material, to conduct processing in exactly the same manner as that of the first anisotropic magnet above.

With respect to Ti, V, Nb, Ta, Al, and Si, by means of adding one or a plurality of these elements to the components of the R—Fe—B system anisotropic magnet, the effects of an increase in the coercive force and the stable imparting of superior magnetic anisotropy and resistance to corrosion can be obtained; however, when the total amount of these elements which is contained is less than 0.001 atomic %, the desired effects cannot be obtained, while on the other hand, when this amount exceeds 5.0 atomic %, the magnetic characteristics worsen. Accordingly, the total amount of one or a plurality of Ti, V, Nb, Ta, Al, and Si which is contained is set to a value in the range of 0.001–5.0 atomic %.

Furthermore, in the case of this second anisotropic magnet, even in the case in which at least one of Co, Ni, Cu, Zn, Ga, Ge, Zr, Mo, Hf, and W is contained in an amount of 0,001–5.0 atomic % in addition to the above composition, superior magnetic anisotropy and resistance to corrosion can be obtained.

The third anisotropic magnet in accordance with the present invention is a R—Fe—Co—B system anisotropic magnet comprising a hot press molded body or an HIP molded body having a composition .comprising 10–20 atomic % of R, 0.1–50 atomic % of Co, 3–20 atomic % of B, and one or a plurality of Ga, Zr, and Hf in a total amount of 0.001–5.0 atomic %, wherein the remainder comprises Fe or unavoidable impurities; the hot press molded body or HIP molded body above has an aggregate structure of crystallized grains having as a main phase thereof a $R_2(Fe, Co)_{14}B$ type intermetallic compound having a tetragonal structure, the crystallized grains possessing an average grain diameter of 0.05–20 μm, and more than 50 volume % of the individual crystallized grains comprising the above aggregate structure have a ratio b/a of the smallest grain diameter a and the largest grain diameter b having a value less than 2.

This third anisotropic magnet, as in the cases of the first and second anisotropic magnets above, also has a temperature coefficient of the coercive force which is small, and in comparison with the conventional rolled magnets, has almost no localized variations in magnetic anisotropy and also possesses superior resistance to corrosion. Furthermore, as the magnet has a crystallized grain aggregate structure, it has superior magnetic anisotropy and a high coercive force in the vicinity of a $R_2(Fe, Co)_{14}B$ type compound composition, that is to say, in the vicinity of a $R_{11.8}(Fe, Co)_{bal}B_{5.9}$ (atomic %) composition.

It is acceptable to add one or a plurality of Al, V, and Si in a total amount of 0.01–2.0 atomic % to the composition of this third anisotropic magnet. In such a case, the maximum energy product will be further increased.

In manufacturing this third R—Fe—Co—B system anisotropic magnet, first, a R—Fe—Co—B system mother alloy having a fixed component composition possessing Ga, Zr, and Hf, or a R—Fe—Co—B system mother alloy having a fixed component composition in which Al, V, and Si are added to the above alloy, is manufactured.

Next, this R—Fe—Co—B system mother alloy is heated in an atmosphere of hydrogen gas, is subjected to heat treatment at a temperature of 500°–1000° C. in an atmosphere of hydrogen gas or a mixed atmosphere of hydrogen gas and an inert gas, and then hydrogen removal processing is carried out at a temperature of 500°–1000° C. so as to produce a vacuum atmosphere having a hydrogen gas pressure of less than 1 Torr or an inert gas atmosphere in which the partial pressure of hydrogen gas is less than 1 Torr, and by cooling this, a R—Fe—Co—B system permanent magnetic powder is obtained.

By means of the addition of a procedure for homogenizing processing at a temperature of 600°–1200° C. prior to the conducting of the above heat treatment of the R—Fe—Co—B system mother alloy above, and by means of the addition of a procedure for heat treatment at a temperature of 300°–1000° C. after the hydrogen desorped processing above, it is possible to create a R—Fe—Co—B system permanent magnetic powder having more superior magnetic anisotropy and resistance to corrosion.

The structure of the R—Fe—Co—B system permanent magnetic powder produced in the above manner comprises a recrystallized aggregate structure in which $R_2(Fe, Co)_{14}B$ type intermetallic compound phase recrystallized grains, which are free of impurities or strains within the grains or at the grain boundaries, are aggregated. The average recrystallized grain diameter of the recrystallized grains comprising this recrystallized aggregate structure is sufficiently within a range of 0.05-20 μm; however, a range of 0.05-3 μm, which is close to the dimensions of a single magnetic domain grain diameter (approximately 0.3 μm), is more preferable.

It is preferable that the individual recrystallized grains having the above dimensions have a form such that the value of the ratio b/a of the smallest grain diameter a and the largest grain diameter b be less than 2; it is necessary that recrystallized grains having this form be present in an amount of more than 50 volume % of the total recrystallized grains comprising the structure of the individual powders. By means of setting the form of the recrystallized grains so that the ratio b/a of the smallest grain diameter a and the largest grain diameter b have a value of less than 2, the coercive force of the R—Fe—Co—B system permanent magnetic powder is improved, and the coercive force temperature coefficient αiHc in the temperature range of 25° C.-100° C. becomes smaller than −0.6%/°C.

Furthermore, as the recrystallized structure of the R—Fe—Co—B system permanent magnetic powder produced in this manner has a recrystallized aggregate structure comprising materially only $R_2(Fe, Co)_{14}B$ type intermetallic compound phase in which a grain boundary phase is almost nonexistent, it is possible to raise the magnetization values of only the portion having no grain boundary phase, corrosion proceeding along the grain boundary phase is halted, and furthermore, as stress deformation resulting from thermoplastic processes does not exists, the likelihood of stress corrosion is small, and the resistance to corrosion thus increases.

Next, the R—Fe—Co—B system permanent magnetic powder above is pressed to a green compact in a magnetic field, and by subjecting this green compact to hot pressing or a HIP process at a temperature of 600° C.-900° C., it is possible to produce a R—Fe—Co—B system anisotropic magnet which preserves the superior characteristics of the R—Fe—Co—B system permanent magnetic powder above. Furthermore, by conducting heat processing at 300° C.-1000° C. where necessary, it is possible to increase the coercive force.

When the green compact above is sintered by a conventional method, as the sintering temperature is normally high, the fine recrystallized grains of the R—Fe—Co—B system permanent magnetic powder grow into large crystallized grains, and as the magnetic characteristics, and particularly the coercive force, worsen, this is not preferable. Furthermore, as the imparting of magnetic anisotropy is conducted in a magnetic field, it is not necessary to conduct a thermoplastic process after hot pressing or the HIP process.

Among the components comprising this third anisotropic magnet, the reasons for the limitations of the contained amount of R, B, and one or a plurality of Ga, Zr, and Hf, and the reasons for the limitation of the average crystallized grain diameter and crystallized grain form, are the same as in the case of the first anisotropic magnet which was discussed previously.

With respect to the amount of Co contained, by adding Co to the composition of the anisotropic magnet, the coercive force and magnetic temperature characteristics (for example, the Curie point) of the anisotropic magnet are improved, and moreover, the effect of an increase in the resistance to corrosion is obtained; however, when the amount contained thereof is less than 0.1 atomic %, these effects cannot be obtained, while on the other hand, when the amount exceeds 50 atomic %, the magnetic characteristics worsen, so that this is not preferable. Accordingly, the amount of Co contained is set to a range of 0.1-50 atomic %. When the amount of Co contained is in a range of 0.1-20 atomic %, the coercive force increases to the greatest extent, so that it is most preferable to set the amount of Co contained to 0.1-20 atomic %.

Furthermore, the reasons for the limitation of the preferable range of amounts of Al, V, and Si contained are the same as in the case of the first anisotropic magnet which was discussed previously.

The fourth anisotropic magnet in accordance with the present invention is a R—Fe—Co—B system anisotropic magnet which is a hot press molded body or a HIP molded body having a composition containing 10-20 atomic % of R, 0.1-50 atomic % of Co, 3-20 atomic % of B, 1 or a plurality of Ti, V, Nb, Ta, Al, and Si in a total amount of 0.001-5.0 atomic %, wherein the remainder comprises Fe and unavoidable impurities; the hot press molded body or HIP molded body above has an aggregate structure of crystallized grains having as a main phase thereof $R_2(Fe, Co)_{14}B$ type intermetallic compound having a tetragonal structure, the crystallized grains having an average grain diameter of 0.05-20 μm, and more than 50 volume % of the total crystallized grains comprising the above aggregate structure have a ratio b/a of the smallest grain diameter a and the largest grain diameter b which has a value of less than 2.

As in the case of the first through third anisotropic magnets above, this fourth anisotropic magnet has a small coercive force temperature coefficient, has almost no localized variations in magnetic anisotropy in comparison with conventional rolled magnets, has superior corrosion resistance, and as this magnet possesses a crystallized grain aggregate structure, it has superior magnetic anisotropy and a high coercive force even in the vicinity of a $R_2(Fe, Co)_{14}B$ type compound composition, that is to say, in the vicinity of a $R_{11.8}(Fe, Co)_{bal}B_{5.9}$ (atomic %) composition.

In order to produce this fourth anisotropic magnet, first, a R—Fe—Co—B system mother alloy having a fixed component composition containing one or a plurality of Ti, V, Nb, Ta, Al, and Si is subjected to melt casting, and using this as a raw material, it is acceptable to conduct processing which is identical to that in the case of the third anisotropic magnet above.

The reasons for the limitation of R, B, Co, the average crystallized grain diameter, and the crystallized grain form in the component composition of the anisotropic magnet of the present invention as given above are the same as in the case of the third anisotropic magnet which was previously discussed. Furthermore, the reason for the limitation of the numerical value of the total contained amount of Ti, V, Nb, Ta, Al, and Si is the same as in the case of the second anisotropic magnet previously discussed.

Even if this fourth anisotropic magnet contains at least one of Ni, Cu, Zn, Ga, Ge, Zr, Mo, Hf, and W in an amount of 0.001–5.0 atomic %, it possesses superior magnetic anisotropy and resistance to corrosion.

EXAMPLES

Next, the first through fourth anisotropic magnets in accordance with the present invention were produced in the following manner, and the characteristics thereof were determined.

Examples of the First Anisotropic Magnet

Ingots of various alloys containing one or a plurality of Ga, Zr, and Hf obtained by plasma melting and casting, and ingots of alloys which contained no Ga, Zr, or Hf were subjected to homogenizing processing in an atmosphere of argon gas at a temperature of 1130° C. for a period of 20 hours, and after this, these homogenized processed ingots were crushed to a fineness of approximately 20 mm to create a raw material alloy.

The raw material alloy was taken from room temperature to a temperature of 830° C. in an atmosphere of hydrogen gas at 1 atmosphere, heat treatment was conducted in a hydrogen atmosphere at a temperature of 830° C. for a period of 4 hours, and next, hydrogen was desorped so as to obtain a vacuum degree of less than $1\times10^{-1}$ Torr at a temperature of 830° C., and immediately thereafter, argon gas was introduced and rapid cooling conducted. After this, hydrogen treatment had been completed, heat processing was conducted in argon gas at a temperature of 650° C. The raw material alloy which was obtained was crushed slightly in a mortar, and a R—Fe—B system permanent magnetic powder having a mean particle size of 50 μm was obtained.

A green compact was formed by press forming these R—Fe—B permanent magnetic powders in a 25 KOe magnetic field, and hot pressing these green compacts at a temperature of 720° C. and at a pressure of 1.5 Ton/cm$^2$. By further heat processing these molded bodies in a vacuum at a temperature of 620° C. for a period of 2 hours, the R—Fe—B system anisotropic magnets 1–26 of the present invention and the R—Fe—B system anisotropic magnets 1–12 of the comparative R—Fe—B were obtained. The green compacts which were formed in a magnetic field were arranged and subjected to hot pressing in such a manner that the orientation direction was identical to the direction of pressing at the time of hot pressing.

On the other hand, the R—Fe—B permanent magnetic powder which was produced from alloy ingots containing no Ga, Zr, or Hf was placed in a copper can in a vacuum, this was heated to a temperature of 720° C., and rolling was conducted a number of times so that the rolling ratio reached a value of 80%, and the conventional R—Fe—B system anisotropic magnet 1 was obtained.

The component elements of the R—Fe—B system anisotropic magnets 1–26 of the present invention, the comparative R—Fe—B system anisotropic magnets 1–12, and the conventional R—Fe—B system anisotropic magnet 1 which were obtained in the above manner are shown in Tables 1–3.

Furthermore, with respect to the R—Fe—B system anisotropic magnets 1–26, comparative R—Fe—B system anisotropic magnets 1–12 and the conventional R—Fe—B system anisotropic magnet 1 having the component elements shown in Tables 1–3, the average crystallized grain diameter, the amount (volume %) of crystallized grains present having a form such that the value of the largest grain diameter/smallest grain diameter is less than 2, the coercive force temperature coefficient αiHc, and the magnetic characteristics were determined. These values are shown in Tables 4–6.

The coercive force $iHc_{25}$ at 25° C. and the coercive force $iHc_{100}$ at 100° C. were measured, and the above coercive force temperature coefficient αiHc has a value determined by the division of the proportional difference of the above coercive forces $(iHc_{100}-iHc_{25})/iHc_{25}$ divided by the temperature difference of 75° C.

It was determined from the results of Tables 1–6 that the R—Fe—B system anisotropic magnets which were produced by the hot pressing of a green compact obtained by the press formation in a vacuum of R—Fe—B system permanent magnetic powders containing one or a plurality of Ga, Zr, and Hf, in accordance with the present invention, had superior magnetic characteristics, and in particular, had superior maximum energy product $(BH)_{max}$ and residual magnetic flux density Br, and had superior magnetic anisotropy.

However, the comparative anisotropic magnets containing no Ga, Zr, or Hf, and those comparative anisotropic magnets which did not fulfill the conditions of the present invention, had poor magnetic characteristics and magnetic anisotropy. Furthermore, in comparison with the conventional anisotropic magnet which was obtained by means of rolling, the anisotropic magnets of the present invention had magnetic characteristics which were essentially identical; however, the coercive force temperature coefficient αiHc was clearly smaller at a value of approximately −0.5%/°C.

TABLE 1

| CLASSIFICATION | | COMPONENT ELEMENTS (ATOMIC %) | | | | | | | | | |
|---|---|---|---|---|---|---|---|---|---|---|---|
| | | | | | | | TOTAL AMOUNT | | | | |
| | | Nd | Dy | Pr | Tb | B | Ga | Zr | Hf | | Fe |
| R—Fe—B SYSTEM ANISOTROPIC MAGNETS OF THE PRESENT INVENTION | 1 | 12.2 | — | 0.3 | — | 6.0 | 0.01 | — | — | 0.01 | * |
| | 2 | 12.0 | — | 0.2 | — | 6.1 | 0.5 | — | — | 0.5 | * |
| | 3 | 12.0 | 0.5 | — | — | 6.0 | 1.0 | — | — | 1.0 | * |
| | 4 | 12.1 | 0.3 | — | — | 6.0 | 5.0 | — | — | 5.0 | * |
| | 5 | 12.1 | — | 0.2 | 0.2 | 6.3 | — | 0.01 | — | 0.01 | * |
| | 6 | 12.2 | — | 0.2 | 0.2 | 6.2 | — | 0.1 | — | 0.1 | * |
| | 7 | 12.1 | — | 0.2 | 0.1 | 6.3 | — | 1.0 | — | 1.0 | * |
| | 8 | 12.1 | — | 0.2 | 0.2 | 6.3 | — | 5.0 | — | 5.0 | * |
| | 9 | 12.0 | 0.2 | 0.2 | — | 6.4 | — | — | 0.01 | 0.01 | * |
| | 10 | 12.1 | 0.2 | 0.2 | — | 6.5 | — | — | 0.1 | 0.1 | * |
| | 11 | 11.9 | 0.2 | 0.2 | — | 6.3 | — | — | 1.0 | 1.0 | * |
| | 12 | 12.0 | 0.2 | 0.2 | — | 6.4 | — | — | 5.0 | 5.0 | * |
| | 13 | 12.0 | 0.3 | — | — | 6.1 | — | 0.2 | 0.1 | 0.3 | * |

TABLE 1-continued

| CLASSIFICATION | | COMPONENT ELEMENTS (ATOMIC %) Nd | Dy | Pr | Tb | B | Ga | Zr | Hf | TOTAL AMOUNT | Fe |
|---|---|---|---|---|---|---|---|---|---|---|---|
| | 14 | 12.1 | 0.3 | — | — | 6.0 | — | 2.0 | 2.0 | 4.0 | * |

*BALANCE

TABLE 2

| CLASSIFICATION | | COMPONENT ELEMENTS (ATOMIC %) Nd | Dy | Pr | Tb | B | Ga | Zr | Hf | TOTAL AMOUNT | Fe |
|---|---|---|---|---|---|---|---|---|---|---|---|
| R—Fe—B SYSTEM ANISOTROPIC MAGNETS OF THE PRESENT INVENTION | 15 | 12.6 | — | — | — | 6.0 | 0.5 | 0.2 | 0.1 | 0.8 | * |
| | 16 | 12.4 | — | — | — | 6.1 | 0.5 | 0.1 | — | 0.6 | * |
| | 17 | 12.1 | — | — | — | 6.0 | 0.5 | — | 0.1 | 0.6 | * |
| | 18 | 16.5 | — | 0.2 | — | 6.1 | 0.5 | 0.05 | — | 0.55 | * |
| | 19 | 16.5 | — | 0.2 | — | 6.1 | 0.5 | 0.05 | — | 0.55 | * |
| | 20 | 20.0 | — | — | — | 7.0 | 1.0 | — | 0.05 | 1.05 | * |
| | 21 | 15.0 | — | — | — | 8.0 | 0.6 | 0.1 | — | 0.7 | * |
| | 22 | 17.0 | — | — | — | 3.0 | 1.0 | — | 0.1 | 1.1 | * |
| | 23 | 13.0 | — | — | — | 10.0 | — | 0.1 | 0.1 | 0.2 | * |
| | 24 | 14.0 | — | — | — | 20.0 | — | 0.1 | 0.1 | 0.2 | * |
| | 25 | 10.0 | — | — | — | 7.0 | 1.0 | — | — | 1.0 | * |
| | 26 | 13.0 | — | — | — | 6.0 | 1.0 | — | — | 1.0 | * |

*BALANCE

TABLE 3

| CLASSIFICATION | | COMPONENT ELEMENTS (ATOMIC %) Nd | Dy | Pr | Tb | B | Ga | Zr | Hf | TOTAL AMOUNT | Fe |
|---|---|---|---|---|---|---|---|---|---|---|---|
| COMPARATIVE R—Fe—B SYSTEM ANISOTROPIC MAGNETS | 1 | 12.2 | 0.2 | — | — | 6.3 | 7.0 ※ | — | — | 7.0 ※ | * |
| | 2 | 12.2 | 0.2 | — | — | 6.3 | — | 7.0 ※ | — | 7.0 ※ | * |
| | 3 | 12.3 | 0.2 | — | — | 6.3 | — | — | 7.0 ※ | 7.0 ※ | * |
| | 4 | 12.2 | 0.4 | — | — | 6.3 | — | 3.0 | 3.0 | 6.0 ※ | * |
| | 5 | 12.2 | 0.3 | — | — | 6.3 | 3.5 | 5.0 | — | 8.5 ※ | * |
| | 6 | 12.2 | — | — | — | 6.1 | 0.5 | — | — | 0.5 | * |
| | 7 | 16.0 | — | — | — | 8.0 | 0.5 | — | — | 0.5 | * |
| | 8 | 25.0 ※ | — | — | — | 8.0 | — | 0.1 | — | 0.1 | * |
| | 9 | 8.0 ※ | — | — | — | 8.0 | — | 0.1 | — | 0.1 | * |
| | 10 | 16.0 | — | — | — | 2.0 ※ | — | — | 0.1 | 0.1 | * |
| | 11 | 14.0 | — | — | — | 25.0 ※ | — | 0.1 | 0.1 | 0.2 | * |
| | 12 | 15.0 | — | — | — | 8.0 | — | — | — | — | * |
| CONVENTIONAL R—Fe—B SYSTEM ANISOTROPIC MAGNET 1 | | 15.0 | — | — | — | 8.0 | — | — | — | — | * |

(※INDICATES VALUES WHICH DO NOT FULFILL THE CONDITIONS OF THE PRESENT INVENTION)
*BALANCE

TABLE 4

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| R—Fe—B SYSTEM ANISOTROPIC MAGNETS OF THE PRESENT INVENTION | 1 | 0.4 | 90 | −0.51 | 10.5 | 11.1 | 24.2 |
| | 2 | 0.3 | 80 | −0.50 | 11.4 | 13.0 | 29.0 |
| | 3 | 1.0 | 90 | −0.49 | 11.7 | 13.5 | 31.0 |
| | 4 | 0.4 | 80 | −0.51 | 10.4 | 10.5 | 23.6 |
| | 5 | 0.5 | 90 | −0.50 | 11.0 | 10.1 | 27.5 |
| | 6 | 0.1 | 90 | −0.49 | 12.2 | 8.8 | 34.3 |
| | 7 | 0.3 | 80 | −0.49 | 11.1 | 7.6 | 27.7 |
| | 8 | 0.05 | 100 | −0.48 | 10.3 | 7.0 | 23.1 |
| | 9 | 0.5 | 90 | −0.51 | 10.9 | 9.8 | 26.9 |
| | 10 | 0.5 | 80 | −0.50 | 12.2 | 9.5 | 33.6 |
| | 11 | 0.1 | 100 | −0.50 | 11.0 | 8.5 | 27.0 |
| | 12 | 0.05 | 90 | −0.49 | 10.4 | 7.8 | 24.5 |
| | 13 | 0.3 | 80 | −0.51 | 11.9 | 9.8 | 32.2 |
| | 14 | 0.6 | 80 | −0.50 | 10.7 | 7.1 | 25.8 |

TABLE 5

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| R—Fe—B SYSTEM ANISOTROPIC MAGNETS OF THE PRESENT INVENTION | 15 | 0.3 | 90 | −0.49 | 11.9 | 13.8 | 33.5 |
| | 16 | 0.2 | 90 | −0.48 | 12.4 | 14.0 | 35.5 |
| | 17 | 0.2 | 80 | −0.49 | 12.4 | 13.2 | 35.3 |
| | 18 | 1.0 | 60 | −0.52 | 11.0 | 13.7 | 25.8 |
| | 19 | 1.0 | 50 | −0.55 | 10.5 | 12.5 | 22.6 |
| | 20 | 0.5 | 90 | −0.54 | 10.4 | 10.3 | 23.5 |
| | 21 | 0.5 | 80 | −0.51 | 12.0 | 14.8 | 34.0 |
| | 22 | 0.3 | 70 | −0.51 | 10.3 | 7.6 | 20.6 |
| | 23 | 0.5 | 80 | −0.52 | 11.2 | 8.8 | 24.2 |
| | 24 | 1.0 | 90 | −0.52 | 10.2 | 5.6 | 19.0 |
| | 25 | 0.5 | 80 | −0.53 | 10.1 | 7.0 | 18.2 |
| | 26 | 3.0 | 90 | −0.53 | 10.8 | 9.8 | 21.3 |

TABLE 6

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | αiHc (%/°C.) | MAGNETIC CHARACTERISTICS Br (KG) | iHc (KOe) | BHmax (MGOe) |
|---|---|---|---|---|---|---|---|
| COMPARATIVE R—Fe—B SYSTEM ANISOTROPIC MAGNETS | 1 | 0.6 | 80 | −0.50 | 9.1 | 7.4 | 11.3 |
| | 2 | 0.6 | 90 | −0.50 | 9.7 | 3.6 | 8.5 |
| | 3 | 0.5 | 100 | −0.49 | 9.5 | 3.3 | 8.0 |
| | 4 | 0.8 | 90 | −0.50 | 9.5 | 3.5 | 9.1 |
| | 5 | 1.0 | 80 | −0.51 | 9.0 | 4.2 | 8.2 |
| | 6 | 0.01※ | 90 | −0.41 | 8.4 | 2.5 | <5 |
| | 7 | 22※ | 90 | −0.73 | 6.0 | 2.1 | <5 |
| | 8 | 0.5 | 90 | −0.60 | 8.3 | 2.2 | <5 |
| | 9 | 0.3 | 80 | — | 4.5 | 0.5 | <5 |
| | 10 | 1.0 | 90 | — | 3.3 | 0.8 | <5 |
| | 11 | 1.0 | 80 | — | 3.0 | 0.7 | <5 |
| | 12 | 0.5 | 90 | −0.53 | 8.0 | 11.3 | 13.1 |
| CONVENTIONAL R—Fe—B SYSTEM ANISOTROPIC MAGNET 1 | | 0.8 | 40※ | −0.68 | 11.8 | 11.5 | 31.1 |

(※INDICATES VALUES WHICH DO NOT FULFILL THE CONDITIONS OF THE PRESENT INVENTION)

Other Examples of the First Anisotropic Magnet

Next, various alloy ingots having component compositions containing one or a plurality of Al, V, and Si in addition to a R—Fe—B system alloy containing one or a plurality of Ga, Zr, and Hf, which were obtained by means of high frequency induction melting and casting, were produced, these ingots were subjected to homogenizing processing in an argon gas atmosphere under conditions such that the temperature was 1130° C., and the time of processing was 30 hours, and then these homogenizing processed ingots were crushed to a fineness of approximately 20 mm to create a raw material alloy.

The temperature of this raw material alloy was raised from room temperature to 850° C. in an atmosphere of hydrogen gas at a pressure of 1 atmosphere, heat treatment was conducted in this hydrogen atmosphere at a temperature of 850° C. for 30 minutes, hydrogen was desorped at a temperature of 850° C. so as to create a vacuum degree of less than $1\times10^{-1}$ Torr, and immediately thereafter, Ar gas was introduced and rapid cooling was conducted. After this hydrogen treatment, the alloy was lightly crushed in a mortar and R—Fe—B system permanent magnetic powders having a mean particle size of 60 μm were obtained.

These R—Fe—B system permanent magnetic pounders were formed in a magnetic field so as to produce green compacts, these green compacts were vacuum filled and sealed in stainless steel vessels, an HIP process was conducted under conditions such that the temperature was 700° C. and the pressure was 1.8 Ton/cm$^2$, and thereby, the R—Fe—B system anisotropic magnets 27–36 of the present invention and the comparative R—Fe—B system anisotropic magnets 13–15 were produced.

The component elements of the R—Fe—B system anisotropic magnets 27–36 of the present invention and the comparative R—Fe—B system anisotropic magnet 13–15 are shown in Table 7. Furthermore, the average crystallized grain diameter, the amount (volume %) of crystallized grains present for which the value of the ratio of the largest grain diameter/smallest grain diameter was less than 2, the coercive force temperature coefficient αiHc determined by the above method, and the magnetic characteristics of these anisotropic magnets were determined, and the results thereof are shown in Table 8.

As is clear from the results of Tables 7 and 8, with respect to anisotropic magnets in which one or a plurality of Ga, Zr, and Hf were added in a total amount of 0.001–5.0 atomic % and one or a plurality of Al, V, and Si were added in a total amount of 0.1–2.0 atomic %, the maximum energy product was further increased, and more striking magnetic anisotropy was obtained, while the coercive force temperature coefficient αiHc was also reduced to a value of approximately −0.5%/°C.

TABLE 7

| CLASSIFICATION | | COMPONENT ELEMENTS (ATOMIC %) Nd | B | TOTAL AMOUNT Ga | Zr | Hf | | TOTAL AMOUNT Al | V | Si | | Fe |
|---|---|---|---|---|---|---|---|---|---|---|---|---|
| R—Fe—B SYSTEM | 27 | 12.6 | 6.5 | 1.0 | — | — | 1.0 | 0.3 | — | — | 0.3 | * |
| ANISOTROPIC MAGNETS | 28 | 12.6 | 6.5 | 1.0 | — | — | 1.0 | 0.1 | 0.1 | — | 0.2 | * |
| OF THE PRESENT | 29 | 12.6 | 6.5 | 1.0 | — | — | 1.0 | — | — | 0.5 | 0.5 | * |
| INVENTION | 30 | 12.6 | 6.5 | — | 0.1 | — | 0.1 | 0.5 | — | — | 0.5 | * |
| | 31 | 12.5 | 6.5 | — | 0.1 | — | 0.1 | — | 0.4 | — | 0.4 | * |
| | 32 | 12.6 | 6.5 | — | 0.1 | — | 0.1 | — | — | 0.5 | 0.5 | * |
| | 33 | 12.5 | 6.5 | — | — | 0.1 | 0.1 | 1.0 | — | — | 1.0 | * |
| | 34 | 12.5 | 6.5 | — | — | 0.1 | 0.1 | — | 0.2 | — | 0.2 | * |
| | 35 | 12.6 | 6.5 | — | — | 0.1 | 0.1 | — | — | 0.5 | 0.5 | * |
| | 36 | 12.5 | 6.5 | 0.5 | — | — | 0.5 | 0.3 | 0.3 | 0.3 | 0.9 | |
| COMPARATIVE R—Fe—B | 13 | 12.6 | 6.5 | 1.0 | — | — | 1.0 | 3.0※ | — | — | 3.0※ | * |
| SYSTEM ANISOTROPIC | 14 | 12.6 | 6.5 | 1.0 | — | — | 1.0 | — | 3.0※ | — | 3.0※ | * |
| MAGNETS | 15 | 12.6 | 6.5 | 1.0 | — | — | 1.0 | — | — | 3.0※ | 3.0※ | * |

(※INDICATES VALUES WHICH DO NOT FULFILL THE CONDITIONS OF THE PRESENT INVENTION)
*BALANCE

TABLE 8

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| R—Fe—B SYSTEM | 27 | 0.2 | 80 | −0.50 | 11.8 | 14.2 | 31.5 |
| ANISOTROPIC | 28 | 0.4 | 90 | −0.50 | 12.0 | 13.8 | 32.2 |
| MAGNETS OF | 29 | 0.2 | 90 | −0.50 | 12.1 | 14.0 | 33.0 |
| THE PRESENT | 30 | 0.5 | 90 | −0.50 | 12.2 | 11.4 | 35.0 |
| INVENTION | 31 | 0.1 | 90 | −0.49 | 12.3 | 9.9 | 34.8 |
| | 32 | 0.3 | 100 | −0.50 | 12.5 | 12.0 | 36.1 |
| | 33 | 0.4 | 80 | −0.51 | 12.2 | 10.9 | 34.5 |
| | 34 | 0.2 | 90 | −0.50 | 12.2 | 10.2 | 34.0 |
| | 35 | 0.3 | 90 | −0.50 | 12.5 | 11.8 | 36.0 |
| | 36 | 0.4 | 90 | −0.50 | 11.5 | 14.2 | 31.3 |
| CONVENTIONAL | 13 | 0.5 | 80 | −0.51 | 11.1 | 12.1 | 24.6 |
| R—Fe—B SYSTEM | 14 | 0.5 | 90 | −0.51 | 11.0 | 10.3 | 21.3 |
| ANISOTROPIC | 15 | 0.4 | 80 | −0.52 | 11.0 | 11.5 | 25.0 |
| MAGNET | | | | | | | |

Examples of the Second Anisotropic Magnet

Next, a second anisotropic magnet in accordance with the present invention was produced in the manner described hereinbelow, and the characteristics thereof were determined.

Ingots of various alloys containing one or a plurality of Ti, V, Nb, Ta, Al, and Si, and ingots of alloys containing none of Ti, V, Nb, Ta, Al, or Si, which were obtained by means of plasma melting and casting, were subjected to homogenizing processing in an atmosphere of Ar gas under conditions such that the temperature thereof was 1140° C., and the processing time was 20 hours, and these homogenizing processed ingots were then crushed to a fineness of approximately 20 mm to produce raw material alloys.

These raw material alloys were raised in temperature from room temperature to 840° C. in an atmosphere of hydrogen gas at a pressure of 1 atmosphere, heat treatment was conducted in this hydrogen atmosphere at a temperature of 840° C. for a period of 1 hour, and then, hydrogen was desorped at a temperature of 830° C. so as to produce a vacuum degree of $1 \times 10^{-1}$ Torr, and directly thereafter, argon gas was introduced, and rapid cooling was conducted. After the conclusion of this hydrogen treatment, heat processing was conducted in a vacuum at a temperature of 620° C. for a period of 2 hours. The raw material alloys obtained were then slightly crushed in a mortar, and magnetic powders having a mean particle size of 40 μm were obtained.

The magnetic powders thus obtained were press formed in a magnetic field of 25 KOe to produce green compacts, and these green compacts were subjected to hot pressing at a temperature of 730° C. and pressure of 1.5 Ton/cm$^2$, or were subjected to a HIP process at a temperature of 700° C. and a pressure of 1.6 Ton/cm$^2$, and furthermore, heat processing was conducted in a vacuum at a temperature of 630° C. for a period of 2 hours. The green compacts which were formed in a magnetic field were arranged and hot pressed in such a manner that the orientation direction was in agreement with the pressed direction at the time of hot pressing.

Among the anisotropic magnets 37–78 of the present invention and comparative anisotropic magnets 16–29 which were produced in this manner, the anisotropic magnets 37–60 according to the present invention and the comparative anisotropic magnets 16–22 were produced by means of the above hot pressing, while the anisotropic magnets 61–78 of the present invention and the comparative anisotropic magnets 23–29 were produced by means of a HIP process. The densities thereof were all suitably accurate, being in a range of 7.5–7.6 g/cm$^3$.

Furthermore, for the purposes of comparison, a R—Fe—B system permanent magnetic powder produced from an ingot of an alloy containing no Ti, V, Nb, Ta, Al, or Si was placed in a copper can in a vacuum, this was heated to a temperature of 700° C., rolling was conducted a number of times so that the rolling ratio thereof was 80%, and a conventional anisotropic magnet 2 was thereby obtained.

The component compositions of the anisotropic magnets 37–78 of the present invention, the comparative anisotropic magnets 16–29 and the conventional anisotropic magnet 2 are shown in Tables 9–14.

Furthermore, the average crystallized grain diameter, the amount (volume %) of crystallized grains present having a form in which the value of the ratio of the largest grain diameter/smallest grain diameter was less than 2, the magnetic characteristics and the coercive force temperature coefficient αiHc of the various anisotropic magnets was measured, and these values are shown in Tables 15–19. The calculation method of the coercive force temperature coefficient αiHc was identical to that given above.

From the results of Table 15–19, it is clear that the anisotropic magnets 37–78 of the present invention, which were produced by conducting hot pressing or a HIP process on green compacts which were press formed in a magnetic field and contained one or a plurality of Ti, V, Nb, Ta, Al, and Si had superior magnetic characteristics, and in particular, had superior maximum energy product $(BH)_{max}$ and residual magnetic flux density Br, and with respect to magnetic anisotropy, had characteristics which were equivalent or superior to those of the conventional anisotropic magnet 2 obtained by means of rolling, and furthermore, with respect to the coercive force temperature coefficient αiHc, the value thereof was clearly smaller than in the case of the conventional anisotropic magnet 2. However, as can be seen from comparative anisotropic magnets 16–29, if the contained amounts of one or a plurality of Ti, V, Nb, Ta, Al, and Si diverged from the ranges of the present invention, magnetic anisotropy worsened, so that this was not preferable.

TABLE 9

| CLASSIFICATION | | COMPONENT ELEMENTS (ATOMIC %) | | | | | | | | | | | |
|---|---|---|---|---|---|---|---|---|---|---|---|---|---|
| | | | | | | | TOTAL AMOUNT | | | | | | |
| | | Nd | Dy | Pr | Tb | B | Ti | V | Nb | Ta | Al | Si | Fe |
| ANISOTROPIC MAGNETS OF THE PRESENT INVENTION | 37 | 12.2 | — | 0.4 | — | 6.0 | 0.01 | — | — | — | — | — | 0.01 | * |
| | 38 | 12.2 | — | 0.3 | — | 6.0 | 0.1 | — | — | — | — | — | 0.1 | * |
| | 39 | 12.2 | — | 0.4 | — | 5.9 | 0.5 | — | — | — | — | — | 0.5 | * |
| | 40 | 12.1 | 0.4 | 0.1 | — | 6.1 | 5.0 | — | — | — | — | — | 5.0 | * |
| | 41 | 12.1 | — | 0.2 | 0.2 | 6.0 | — | 0.01 | — | — | — | — | 0.01 | * |
| | 42 | 12.1 | — | 0.3 | 0.1 | 6.0 | — | 0.1 | — | — | — | — | 0.1 | * |
| | 43 | 12.2 | — | 0.2 | 0.2 | 6.1 | — | 1.0 | — | — | — | — | 1.0 | * |
| | 44 | 12.2 | — | 0.2 | 0.2 | 6.1 | — | 5.0 | — | — | — | — | 5.0 | * |
| | 45 | 12.2 | 0.3 | 0.2 | — | 6.0 | — | — | 0.01 | — | — | — | 0.01 | * |
| | 46 | 12.1 | 0.3 | 0.2 | — | 6.1 | — | — | 0.3 | — | — | — | 0.3 | * |
| | 47 | 12.1 | 0.2 | 0.2 | — | 6.1 | — | — | 1.0 | — | — | — | 1.0 | * |
| | 48 | 12.2 | 0.2 | 0.2 | — | 5.9 | — | — | 5.0 | — | — | — | 5.0 | * |

*BALANCE

TABLE 10

| CLASSIFICATION | | COMPONENT ELEMENTS (ATOMIC %) | | | | | | | | | | | |
|---|---|---|---|---|---|---|---|---|---|---|---|---|---|
| | | | | | | | TOTAL AMOUNT | | | | | | |
| | | Nd | Dy | Pr | Tb | B | Ti | V | Nb | Ta | Al | Si | Fe |
| ANISOTROPIC MAGNETS OF THE PRESENT INVENTION | 49 | 12.0 | 0.3 | 0.2 | — | 6.1 | — | — | — | 0.03 | — | — | 0.03 | * |
| | 50 | 12.0 | 0.3 | 0.2 | — | 6.0 | — | — | — | 0.3 | — | — | 0.3 | * |
| | 51 | 12.1 | 0.3 | 0.2 | — | 6.0 | — | — | — | 3.0 | — | — | 3.0 | * |
| | 52 | 12.0 | 0.3 | 0.2 | — | 5.9 | — | — | — | 5.0 | — | — | 5.0 | * |
| | 53 | 12.2 | — | 0.2 | — | 6.0 | — | — | — | — | 0.01 | — | 0.01 | * |
| | 54 | 12.2 | — | 0.2 | — | 6.1 | — | — | — | — | 0.5 | — | 0.5 | * |
| | 55 | 12.2 | — | 0.2 | — | 6.0 | — | — | — | — | 1.0 | — | 1.0 | * |
| | 56 | 12.2 | — | 0.2 | — | 6.1 | — | — | — | — | 4.6 | — | 4.6 | * |
| | 57 | 12.5 | — | — | — | 6.1 | — | — | — | — | — | 0.05 | 0.05 | * |
| | 58 | 12.5 | — | — | — | 6.0 | — | — | — | — | — | 0.5 | 0.5 | * |
| | 59 | 12.6 | — | — | — | 6.0 | — | — | — | — | — | 1.0 | 1.0 | * |
| | 60 | 12.5 | — | — | — | 6.0 | — | — | — | — | — | 4.9 | 4.9 | * |

*BALANCE

TABLE 11

| CLASSIFICATION | | COMPONENT ELEMENTS (ATOMIC %) | | | | | | | | | | | |
|---|---|---|---|---|---|---|---|---|---|---|---|---|---|
| | | | | | | | TOTAL AMOUNT | | | | | | |
| | | Nd | Dy | Pr | Tb | B | Ti | V | Nb | Ta | Al | Si | Fe |
| ANISOTROPIC MAGNETS OF THE PRESENT INVENTION | 61 | 12.3 | — | — | — | 6.5 | — | — | 0.3 | — | — | 1.5 | 1.8 | * |
| | 62 | 12.3 | — | — | — | 6.5 | — | — | — | 0.3 | 0.1 | 1.0 | 1.2 | * |
| | 63 | 12.2 | — | — | — | 6.4 | — | 0.1 | 0.2 | — | 0.5 | 2.0 | 2.8 | * |
| | 64 | 12.3 | — | — | — | 6.5 | 0.2 | — | 0.3 | — | 2.0 | 1.5 | 4.0 | * |
| | 65 | 12.2 | — | 0.4 | — | 6.5 | — | 0.1 | 0.5 | — | 2.5 | 1.0 | 4.1 | * |
| | 66 | 12.2 | — | 0.4 | — | 6.4 | — | — | — | 0.3 | — | 0.5 | 0.8 | * |
| | 67 | 12.2 | — | 0.4 | — | 6.5 | — | — | 0.1 | 0.3 | 0.2 | 0.2 | 0.8 | * |
| | 68 | 11.9 | — | 0.4 | — | 6.6 | — | — | — | 0.5 | 0.5 | 0.5 | 1.5 | * |
| | 69 | 12.0 | — | 0.3 | — | 6.4 | 0.1 | 0.1 | — | — | 0.5 | 0.5 | 1.2 | * |
| | 70 | 12.0 | — | 0.4 | — | 6.5 | 0.1 | — | 0.3 | — | 0.3 | 0.5 | 1.2 | * |
| | 71 | 11.9 | — | 0.4 | — | 6.5 | 0.1 | 0.1 | 0.1 | 0.1 | 0.1 | 0.1 | 0.6 | * |

*BALANCE

TABLE 12

| CLASSIFICATION | | COMPONENT ELEMENTS (ATOMIC %) | | | | | | | | | | | | |
|---|---|---|---|---|---|---|---|---|---|---|---|---|---|---|
| | | | | | | | TOTAL AMOUNT | | | | | | | |
| | | Nd | Dy | Pr | Tb | B | Ti | V | Nb | Ta | Al | Si | | Fe |
| ANISOTROPIC MAGNETS OF THE PRESENT INVENTION | 72 | 13.0 | 0.9 | — | — | 6.5 | — | — | 0.3 | — | 0.5 | 0.5 | 1.3 | * |
| | 73 | 10.0 | — | — | — | 7.0 | — | — | 0.2 | 0.1 | — | 1.0 | 1.3 | * |
| | 74 | 14.0 | — | — | — | 7.2 | — | — | 0.2 | 0.1 | — | 1.0 | 1.3 | * |
| | 75 | 20.0 | — | — | — | 7.0 | — | — | 0.2 | 0.1 | — | 1.0 | 1.3 | * |
| | 76 | 16.0 | 0.5 | — | — | 3.0 | — | — | — | 0.2 | 0.5 | 0.5 | 1.2 | * |
| | 77 | 12.4 | — | 1.0 | — | 10.0 | — | — | — | 0.3 | 0.7 | — | 1.0 | * |
| | 78 | 14.0 | 1.0 | — | — | 20.0 | — | — | 0.1 | 0.1 | 0.2 | 0.5 | 0.9 | * |

*BALANCE

TABLE 13

| CLASSIFICATION | | COMPONENT ELEMENTS (ATOMIC %) | | | | | | | | | | | | |
|---|---|---|---|---|---|---|---|---|---|---|---|---|---|---|
| | | | | | | | TOTAL AMOUNT | | | | | | | |
| | | Nd | Dy | Pr | Tb | B | Ti | V | Nb | Ta | Al | Si | | Fe |
| COMPARATIVE ANISOTROPIC MAGNETS | 16 | 12.2 | — | 0.3 | — | 6.0 | 7.0※ | — | — | — | — | — | 7.0※ | * |
| | 17 | 12.2 | — | 0.3 | — | 6.1 | — | 7.0※ | — | — | — | — | 7.0※ | * |
| | 18 | 12.2 | — | 0.3 | — | 6.1 | — | — | 7.0※ | — | — | — | 7.0※ | * |
| | 19 | 12.2 | — | 0.3 | — | 6.0 | — | — | — | 6.9※ | — | — | 6.9※ | * |
| | 20 | 12.2 | — | 0.2 | — | 6.0 | — | — | — | — | 7.0※ | — | 7.0※ | * |
| | 21 | 12.2 | — | 0.3 | — | 6.0 | — | — | — | — | — | 7.0※ | 7.0※ | * |
| | 22 | 12.3 | — | 0.3 | — | 6.1 | 3.5 | — | 3.5 | — | — | — | 7.0※ | * |
| | 23 | 12.2 | — | 0.3 | — | 6.0 | — | 3.5 | — | 3.5 | — | — | 7.0※ | * |
| | 24 | 12.1 | — | 0.3 | — | 6.1 | 0.1 | — | 0.1 | — | 0.1 | 0.1 | 0.4※ | * |

( INDICATES VALUES WHICH DO NOT FULFILL THE CONDITIONS OF THE PRESENT INVENTION)
*BALANCE

TABLE 14

| CLASSIFICATION | | COMPONENT ELEMENTS (ATOMIC %) | | | | | | | | | | | | |
|---|---|---|---|---|---|---|---|---|---|---|---|---|---|---|
| | | | | | | | TOTAL AMOUNT | | | | | | | |
| | | Nd | Dy | Pr | Tb | B | Ti | V | Nb | Ta | Al | Si | | Fe |
| COMPARATIVE ANISOTROPIC MAGNETS | 25 | 13.0 | — | 1.5 | — | 7.5 | — | 0.2 | — | 0.2 | — | — | 0.4 | * |
| | 26 | 25.0※ | — | — | — | 7.0 | 1.0 | — | — | — | 0.2 | — | 1.2 | * |
| | 27 | 8.0※ | — | — | — | 7.0 | — | — | 0.5 | — | 1.0 | 0.5 | 2.0 | * |
| | 28 | 16.0 | — | — | — | 2.0※ | — | 0.1 | — | — | — | — | 0.1 | * |
| | 29 | 14.0 | — | — | — | 25.0※ | — | — | 0.1 | 0.1 | — | — | 0.2 | * |
| CONVENTIONAL ANISOTROPIC MAGNET 2 | | 14.1 | — | — | — | 7.2 | — | — | — | — | — | — | —※ | * |

(※INDICATES VALUES WHICH DO NOT FULFILL THE CONDITIONS OF THE PRESENT INVENTION)
*BALANCE

TABLE 15

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS | | |
|---|---|---|---|---|---|---|---|
| | | | | | Br (KG) | iHc (KOe) | BHmax (MGOe) |
| ANISOTROPIC MAGNETS OF THE PRESENT INVENTION | 37 | 0.2 | 80 | −0.53 | 10.4 | 10.8 | 24.0 |
| | 38 | 0.2 | 90 | −0.53 | 10.8 | 10.6 | 25.1 |
| | 39 | 0.5 | 90 | −0.51 | 11.3 | 9.2 | 29.6 |
| | 40 | 0.4 | 100 | −0.51 | 10.2 | 8.0 | 23.3 |
| | 41 | 0.2 | 90 | −0.52 | 10.1 | 10.7 | 22.5 |
| | 42 | 0.1 | 80 | −0.51 | 10.5 | 10.7 | 25.0 |
| | 43 | 0.3 | 90 | −0.52 | 10.6 | 8.8 | 25.4 |
| | 44 | 0.1 | 80 | −0.50 | 10.0 | 7.6 | 23.2 |
| | 45 | 0.5 | 90 | −0.52 | 10.6 | 10.8 | 26.0 |
| | 46 | 0.3 | 100 | −0.52 | 11.7 | 10.2 | 31.2 |
| | 47 | 0.3 | 80 | −0.50 | 11.5 | 9.6 | 30.2 |
| | 48 | 0.05 | 90 | −0.51 | 10.3 | 8.0 | 24.2 |

TABLE 16

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| ANISO-TROPIC MAGNETS OF THE PRESENT INVENTION | 49 | 0.4 | 90 | −0.53 | 10.4 | 10.5 | 24.5 |
| | 50 | 0.2 | 90 | −0.51 | 11.8 | 10.4 | 31.0 |
| | 51 | 0.2 | 90 | −0.51 | 10.7 | 9.7 | 25.2 |
| | 52 | 0.2 | 90 | −0.50 | 10.4 | 9.1 | 24.4 |
| | 53 | 0.3 | 80 | −0.53 | 10.6 | 11.3 | 25.5 |
| | 54 | 0.5 | 80 | −0.51 | 11.8 | 13.5 | 32.1 |
| | 55 | 0.5 | 80 | −0.49 | 11.5 | 13.1 | 29.3 |
| | 56 | 0.3 | 70 | −0.51 | 11.2 | 11.6 | 27.5 |
| | 57 | 0.5 | 90 | −0.52 | 10.6 | 11.3 | 25.8 |
| | 58 | 0.3 | 80 | −0.49 | 12.1 | 13.7 | 33.0 |
| | 59 | 0.3 | 90 | −0.50 | 11.7 | 13.5 | 31.4 |
| | 60 | 0.1 | 90 | −0.49 | 11.2 | 12.6 | 29.2 |

TABLE 17

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| ANISO-TROPIC MAGNETS OF THE PRESENT INVENTION | 61 | 0.2 | 90 | −0.50 | 12.1 | 12.5 | 33.6 |
| | 62 | 0.3 | 80 | −0.49 | 12.4 | 13.0 | 34.8 |
| | 63 | 0.3 | 90 | −0.50 | 10.9 | 12.2 | 26.5 |
| | 64 | 0.2 | 80 | −0.52 | 10.4 | 11.8 | 24.3 |
| | 65 | 0.5 | 90 | −0.51 | 10.3 | 12.6 | 24.4 |
| | 66 | 0.3 | 90 | −0.50 | 12.5 | 13.7 | 35.1 |
| | 67 | 0.5 | 80 | −0.50 | 12.4 | 13.1 | 34.5 |
| | 68 | 0.3 | 90 | −0.51 | 12.2 | 12.8 | 33.8 |
| | 69 | 0.5 | 90 | −0.50 | 11.5 | 13.3 | 30.0 |
| | 70 | 0.5 | 90 | −0.51 | 11.8 | 13.2 | 31.2 |
| | 71 | 0.5 | 90 | −0.51 | 11.4 | 12.4 | 29.6 |

TABLE 18

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| ANISO-TROPIC MAGNETS OF THE PRESENT INVENTION | 72 | 1.0 | 50 | −0.51 | 11.8 | 8.6 | 30.3 |
| | 73 | 0.1 | 90 | −0.50 | 10.4 | 8.5 | 24.6 |
| | 74 | 0.3 | 90 | −0.52 | 12.1 | 13.5 | 33.6 |
| | 75 | 1.0 | 60 | −0.53 | 10.1 | 9.1 | 23.0 |
| | 76 | 0.5 | 80 | −0.53 | 10.2 | 8.0 | 23.1 |
| | 77 | 2.0 | 90 | −0.51 | 11.3 | 9.3 | 28.0 |
| | 78 | 3.0 | 80 | −0.50 | 10.4 | 8.1 | 23.3 |

TABLE 19

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| COMPARATIVE ANISO-TROPIC MAGNETS | 16 | 0.5 | 80 | −0.50 | 9.6 | 3.1 | 8.2 |
| | 17 | 0.5 | 90 | −0.50 | 8.7 | 2.8 | 5.6 |
| | 18 | 0.3 | 80 | — | 9.1 | 2.5 | 6.1 |
| | 19 | 0.5 | 80 | — | 9.3 | 2.6 | 6.0 |
| | 20 | 1.0 | 70 | −0.55 | 8.9 | 3.4 | 5.1 |
| | 21 | 2.0 | 60 | −0.55 | 8.8 | 3.0 | <5 |
| | 22 | 0.5 | 85 | — | 9.5 | 2.4 | <5 |
| | 23 | 0.5 | 80 | — | 9.3 | 2.1 | <5 |
| | 24 | 0.01※ | 90 | −0.50 | 8.3 | 3.3 | <5 |
| | 25 | 22※ | 80 | — | 7.2 | 1.0 | <5 |
| | 26 | 5.0 | 70 | −0.55 | 6.8 | 4.5 | <5 |
| | 27 | 0.5 | 80 | — | 7.1 | 0.6 | <5 |
| | 28 | 2.0 | 90 | — | 7.0 | 0.8 | <5 |

TABLE 19-continued

| CLASSIFICATION | AVERAGE CRYSTAL GRAIN DIAMETER (μm) | AMOUNT OF CRYSTAL GRAINS PRESENT FOR WHICH THE LARGEST GRAIN DIAMETER/SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|
| 29 | 0.5 | 80 | −0.55 | 6.4 | 3.3 | <5 |
| CONVENTIONAL ANISOTROPIC MAGNET 2 | 0.8 | 40※ | −0.70 | 11.9 | 12.0 | 31.6 |

(※INDICATES VALUES WHICH DO NOT FULFILL THE CONDITIONS OF THE PRESENT INVENTION)

Examples of the Third Anisotropic Magnet

Next, a third anisotropic magnet in accordance with the present invention was produced in the manner described hereinafter, and the characteristics thereof were determined.

Ingots of various R—Fe—Co—B system alloys containing Co and one or a plurality of Ga, Zr, and Hf, and ingots of R—Fe—Co—B system alloys containing no Ga, Zr, or Hf which were obtained by means of plasma melting and casting, were prepared, these alloy ingots were subjected to homogenizing processing in an argon gas atmosphere under conditions such that the temperature thereof was 1120° C., and the processing time was 40 hours, and thereafter, these homogenizing processed ingots were crushed to a fineness of 20 mm to form a raw material alloy.

The temperature of this raw material alloy was raised from room temperature to a temperature of 830° C. in a hydrogen atmosphere at a pressure of 1 atmosphere, heat treatment was conducted in this hydrogen atmosphere at a temperature of 830° C. for a period of 4 hours, and then, hydrogen was desorped at a temperature of 830° C. so as to produce a vacuum degree of less than $1\times10^{-1}$ Torr, and directly thereafter, argon gas was introduced and rapid cooling conducted.

After the conclusion of the above hydrogen treatment, the ingots were slightly crushed in mortars, and various R—Fe—Co—B system permanent magnetic powders having a mean particle size of 50 μm were obtained.

These R—Fe—Co—B system permanent magnetic powders were press formed in a magnetic field so as to form green compacts, and these green compacts were subjected to hot pressing under conditions such that the temperature was 700° C. and the pressure was 1.5 Ton/cm$^2$. At this time, arrangement and hot pressing were conducted in such a manner that the orientation direction was identical with the press direction at the time of hot pressing.

By means of further subjecting the various molded bodies to heat processing at a temperature of 620° C. and for a period of 2 hours, the anisotropic magnets 79–109 of the present invention and the comparative anisotropic magnets 30–39 shown in Tables 20–23 were produced. The densities of these anisotropic magnets were sufficiently accurate, being in a range of 7.5 to 7.6 g/cm$^3$.

On the other hand, a R—Fe—Co—B system permanent magnetic powder produced from an ingot of an alloy containing no Ga, Zr, or Hf was placed in a copper can in a vacuum, this was heated to a temperature of 700° C. and rolling was conducted a number of times so that the rolling ratio reached 80%, and the conventional anisotropic magnet 3 shown in Table 23 was obtained.

The various structures of the anisotropic magnets 79–109 of the present invention, the comparative anisotropic magnets 30–39, and the conventional anisotropic magnet 3 having the component compositions shown in Tables 20–22 were observed by means of a scanning electron microscope, and the average crystallized grain diameter, the amount of crystallized grains present having a form in which the ratio of the largest grain diameter/smallest grain diameter had a value of less than 2, the coercive force temperature coefficient αiHc and the magnetic characteristics were determined. The values obtained thereby are shown in Tables 24–27. The method of calculation of the coercive force temperature coefficient αiHc is as given above.

It is clear from the results shown in Tables 20–27 that the anisotropic magnets 79–109 in accordance with the present invention which contain one or a plurality of Ga, Zr, and Hf have superior magnetic characteristics, and in particular, have superior maximum energy product $(BH)_{max}$ and residual magnetic flux density Br, and furthermore, have superior anisotropy. Furthermore, in comparison with the conventional anisotropic magnet 3 obtained by means of rolling, the anisotropic magnet 79–109 of the present invention possess essentially identical magnetic characteristics; however, the coercive force temperature coefficient αiHc thereof is markedly smaller, having a value of approximately −0.5%/°C. In addition, in the case of the comparative anisotropic magnets 30–39, the compositions of which lie outside the ranges of the present invention, the magnetic characteristics and magnetic anisotropy worsen.

TABLE 20

| CLASSIFICATION | | COMPONENT ELEMENTS (ATOMIC %) Nd | Tb | Dy | Pr | Co | B | Ga | Zr | Hf | TOTAL AMOUNT | Fe |
|---|---|---|---|---|---|---|---|---|---|---|---|---|
| ANISOTROPIC MAGNETS OF THE PRESENT INVENTION | 79 | 12.3 | — | — | 0.3 | 11.6 | 6.5 | 0.01 | — | — | 0.01 | * |
| | 80 | 12.0 | — | — | 0.2 | 11.6 | 6.5 | 0.5 | — | — | 0.5 | * |
| | 81 | 12.0 | — | 0.5 | — | 11.6 | 6.4 | 1.0 | — | — | 1.0 | * |
| | 82 | 12.0 | — | 0.3 | — | 11.6 | 6.2 | 5.0 | — | — | 5.0 | * |
| | 83 | 12.1 | 0.2 | — | 0.2 | 11.6 | 6.3 | — | 0.01 | — | 0.01 | * |
| | 84 | 12.2 | 0.2 | — | 0.2 | 11.6 | 6.3 | — | 0.1 | — | 0.1 | * |
| | 85 | 12.1 | 0.1 | — | 0.3 | 11.6 | 6.2 | — | 1.0 | — | 1.0 | * |
| | 86 | 12.1 | 0.2 | — | 0.2 | 11.6 | 6.3 | — | 5.0 | — | 5.0 | * |

TABLE 20-continued

| CLASSIFICATION | COMPONENT ELEMENTS (ATOMIC %) | | | | | | | | | | |
|---|---|---|---|---|---|---|---|---|---|---|---|
| | Nd | Tb | Dy | Pr | Co | B | Ga | Zr | Hf | TOTAL AMOUNT | Fe |
| 87 | 12.0 | — | 0.2 | 0.2 | 11.6 | 6.3 | — | — | 0.01 | 0.01 | * |
| 88 | 12.2 | — | 0.2 | 0.2 | 11.6 | 6.4 | — | — | 0.1 | 0.1 | * |
| 89 | 12.2 | — | 0.2 | 0.2 | 11.6 | 6.3 | — | — | 1.0 | 1.0 | * |
| 90 | 12.0 | — | 0.2 | 0.3 | 11.6 | 6.2 | — | — | 5.0 | 5.0 | * |
| 91 | 12.0 | — | 0.3 | — | 11.6 | 6.3 | — | 0.2 | 0.1 | 0.3 | * |
| 92 | 12.3 | — | 0.3 | — | 11.6 | 6.3 | — | 2.0 | 2.0 | 4.0 | * |

*BALANCE

TABLE 21

| CLASSIFICATION | | COMPONENT ELEMENTS (ATOMIC %) | | | | | | | | | | |
|---|---|---|---|---|---|---|---|---|---|---|---|---|
| | | Nd | Tb | Dy | Pr | Co | B | Ga | Zr | Hi | TOTAL AMOUNT | Fe |
| ANISOTROPIC MAGNETS OF THE PRESENT INVENTION | 93 | 12.2 | — | — | 0.3 | 17.0 | 6.0 | 0.001 | 0.001 | 0.001 | 0.003 | * |
| | 94 | 12.5 | — | — | — | 17.4 | 6.0 | 0.5 | 0.1 | — | 0.6 | * |
| | 95 | 12.2 | — | — | 0.3 | 18.5 | 6.0 | 0.4 | — | 0.1 | 0.5 | * |
| | 96 | 10.0 | — | — | — | 5.0 | 8.0 | 1.0 | — | — | 1.0 | * |
| | 97 | 15.0 | — | — | — | 17.5 | 8.0 | 0.5 | — | 0.1 | 0.6 | * |
| | 98 | 20.0 | — | — | — | 17.6 | 7.0 | 1.0 | — | 0.1 | 1.1 | * |
| | 99 | 12.2 | — | 0.4 | — | 0.1 | 6.0 | 0.5 | — | — | 0.5 | * |
| | 100 | 12.4 | — | 0.3 | — | 5.2 | 6.0 | 0.5 | — | — | 0.5 | * |
| | 101 | 12.3 | — | 0.3 | — | 17.5 | 6.0 | 0.5 | — | — | 0.5 | * |
| | 102 | 12.4 | — | 0.2 | — | 30.0 | 6.0 | 0.5 | — | — | 0.5 | * |
| | 103 | 12.3 | — | 0.3 | — | 50.0 | 6.0 | 0.5 | — | — | 0.5 | * |

*BALANCE

TABLE 22

| CLASSIFICATION | | COMPONENT ELEMENTS (ATOMIC %) | | | | | | | | | | |
|---|---|---|---|---|---|---|---|---|---|---|---|---|
| | | Nd | Tb | Dy | Pr | Co | B | Ga | Zr | Hi | TOTAL AMOUNT | Fe |
| ANISOTROPIC MAGNETS OF THE PRESENT INVENTION | 104 | 16.0 | — | — | — | 11.2 | 3.0 | 1.0 | — | 0.1 | 1.1 | * |
| | 105 | 12.1 | — | — | 0.5 | 6.4 | 10.4 | — | 0.1 | 0.1 | 0.2 | * |
| | 106 | 14.0 | — | — | — | 11.0 | 20.0 | — | 0.1 | — | 0.1 | * |
| | 107 | 13.0 | — | 0.5 | — | 11.5 | 6.1 | 0.5 | — | — | 0.5 | * |
| | 108 | 13.0 | — | 0.5 | — | 11.5 | 6.1 | 0.5 | — | — | 0.5 | * |
| | 109 | 16.0 | — | — | — | 11.3 | 6.0 | 0.5 | — | — | 0.5 | * |

*BALANCE

TABLE 23

| CLASSIFICATION | | COMPONENT ELEMENTS (ATOMIC %) | | | | | | | | | | |
|---|---|---|---|---|---|---|---|---|---|---|---|---|
| | | Nd | Tb | Dy | Pr | Co | B | Ga | Zr | Hi | TOTAL AMOUNT | Fe |
| COMPARATIVE ANISOTROPIC MAGNETS | 30 | 12.5 | — | — | — | 7.0 | 6.0 | 0.5 | — | — | 0.5 | * |
| | 31 | 16.0 | — | — | — | 7.0 | 8.0 | 0.5 | — | — | 0.5 | * |
| | 32 | 12.5 | — | 0.2 | — | 7.1 | 6.3 | 7.9※ | — | — | 7.9※ | * |
| | 33 | 12.3 | — | 0.3 | — | 7.2 | 6.2 | — | 7.0 | 0.2 | 7.2※ | * |
| | 34 | 12.3 | — | 0.2 | — | 7.0 | 6.2 | — | 0.2 | 6.7※ | 6.9※ | * |
| | 35 | 9.0※ | — | — | — | 16.2 | 8.0 | — | 0.1 | — | 0.1 | * |
| | 36 | 25.0※ | — | — | — | 16.5 | 8.0 | 0.5 | — | — | 0.5 | * |
| | 37 | 13.0 | — | — | — | 55.1※ | 7.0 | 1.0 | — | 0.5 | 1.5 | * |
| | 38 | 16.0 | — | — | — | 11.2 | 2.0※ | — | — | 0.1 | 0.1 | * |
| | 39 | 14.0 | — | — | — | 11.2 | 21.7※ | — | 0.1 | 0.1 | 0.2 | * |
| CONVENTIONAL ANISOTROPIC MAGNET 3 | | 14.5 | — | — | — | 17.5 | 8.0 | — | — | — | — | * |

(※INDICATES VALUES WHICH DO NOT FULFILL THE CONDITIONS OF THE PRESENT INVENTION)
*BALANCE

TABLE 24

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| ANISOTROPIC MAGNETS OF THE PRESENT INVENTION | 79 | 0.2 | 80 | −0.50 | 11.3 | 13.3 | 28.3 |
| | 80 | 0.3 | 90 | −0.50 | 12.4 | 14.4 | 35.4 |
| | 81 | 0.3 | 80 | −0.49 | 12.6 | 14.0 | 36.2 |
| | 82 | 1.0 | 80 | −0.48 | 12.5 | 12.1 | 35.0 |

TABLE 24-continued

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| | 83 | 0.3 | 90 | −0.50 | 11.8 | 12.0 | 31.5 |
| | 84 | 0.2 | 90 | −0.49 | 12.9 | 10.6 | 40.1 |
| | 85 | 0.3 | 100 | −0.49 | 12.6 | 9.6 | 36.7 |
| | 86 | 0.05 | 90 | −0.48 | 11.4 | 8.5 | 30.3 |
| | 87 | 0.4 | 80 | −0.51 | 11.8 | 10.8 | 31.0 |
| | 88 | 0.3 | 80 | −0.50 | 12.8 | 10.9 | 38.4 |
| | 89 | 0.2 | 80 | −0.50 | 12.6 | 10.5 | 36.9 |
| | 90 | 0.1 | 90 | −0.48 | 11.5 | 9.6 | 30.5 |
| | 91 | 0.2 | 90 | −0.51 | 11.8 | 11.0 | 32.1 |
| | 92 | 0.05 | 90 | −0.50 | 11.5 | 9.2 | 30.7 |

TABLE 25

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| ANISOTROPIC MAGNETS OF THE PRESENT INVENTION | 93 | 0.5 | 90 | −0.52 | 10.7 | 11.4 | 25.6 |
| | 94 | 0.2 | 90 | −0.49 | 13.1 | 14.0 | 40.6 |
| | 95 | 0.2 | 90 | −0.49 | 13.0 | 13.8 | 40.0 |
| | 96 | 0.1 | 80 | −0.53 | 11.2 | 8.2 | 28.8 |
| | 97 | 0.3 | 100 | −0.51 | 12.4 | 16.3 | 34.5 |
| | 98 | 0.5 | 100 | −0.53 | 11.2 | 11.5 | 26.7 |
| | 99 | 0.5 | 90 | −0.52 | 11.6 | 9.7 | 32.6 |
| | 100 | 0.3 | 90 | −0.52 | 12.1 | 12.1 | 34.0 |
| | 101 | 0.3 | 90 | −0.51 | 13.0 | 12.0 | 39.5 |
| | 102 | 0.1 | 90 | −0.48 | 12.2 | 10.8 | 28.9 |
| | 103 | 0.5 | 90 | −0.48 | 10.9 | 8.7 | 26.1 |

TABLE 26

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| ANISOTROPIC MAGNETS OF THE PRESENT INVENTION | 104 | 0.3 | 90 | −0.52 | 11.2 | 8.3 | 22.6 |
| | 105 | 0.3 | 80 | −0.49 | 11.4 | 9.5 | 25.2 |
| | 106 | 0.4 | 90 | −0.51 | 10.7 | 6.2 | 21.0 |
| | 107 | 0.8 | 60 | −0.53 | 12.4 | 13.3 | 31.6 |
| | 108 | 1.0 | 50 | −0.53 | 12.6 | 12.4 | 33.8 |
| | 109 | 3.0 | 85 | −0.53 | 11.5 | 10.6 | 27.6 |

TABLE 27

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| COMPARATIVE ANISOTROPIC MAGNETS | 30 | 0.01※ | 90 | −0.40 | 8.5 | 3.0 | 5.4 |
| | 31 | 25※ | 70 | −0.74 | 5.9 | 2.5 | <5 |
| | 32 | 0.5 | 80 | −0.53 | 9.2 | 8.0 | 10.6 |
| | 33 | 0.3 | 90 | −0.54 | 9.9 | 3.9 | 10.1 |
| | 34 | 0.3 | 80 | −0.54 | 9.5 | 4.1 | 9.6 |
| | 35 | 1.0 | 90 | — | 4.5 | 0.6 | <5 |
| | 36 | 5.0 | 80 | — | 8.5 | 2.1 | <5 |
| | 37 | 0.3 | 70 | −0.53 | 6.5 | 5.5 | <5 |
| | 38 | 1.0 | 70 | — | 3.2 | 0.9 | <5 |
| | 39 | 1.0 | 90 | — | 3.4 | 1.0 | <5 |
| CONVENTIONAL ANISOTROPIC MAGNET 3 | | 0.8 | 40※ | −0.70 | 11.9 | 13.5 | 31.2 |

(※INDICATES VALUES WHICH DO NOT FULFILL THE CONDITIONS OF THE PRESENT INVENTION)

Other Examples of the Third Anisotropic Magnet

Next, ingots of various alloys having component compositions containing one or a plurality of Al, V, and Si in addition to a R—Fe—Co—B system alloy containing one or a plurality of Ga, Zr, and Hf obtained by means of high frequency induction melting and casting, were prepared; these ingots were processed by a method identical to that of the anisotropic magnets 79–109 and the comparative anisotropic magnets 30–39 above, and R—Fe—Co—B system permanent magnetic powders having a mean particle size of 40 μm were produced. These permanent magnetic powders were press formed in the presence or absence of a magnetic field to form green compacts, these green compacts were subjected to hot isostatic pressing under conditions such that the temperature thereof was 710° C., and the pressure thereof was 1.7 Ton/cm$^2$, and the anisotropic magnets 110–119 of the present invention and the comparative anisotropic magnets 40–42 comprising the component compositions shown in Table 28 were obtained.

The average crystallized grain diameter, the amount (volume %) of crystallized grains present for which the value of the ratio of the largest grain diameter/smallest grain diameter was less than 2, the coercive force temperature coefficient αiHc and the magnetic characteristics of these anisotropic magnets were determined in a manner identical to that above. The results thereof are shown in Table 29.

As can be seen from the results of Tables 28 and 29, by means of adding 0.1–2.0 atomic % of one or a plurality of Al, V, and Si to 0.01–5.0 atomic % of 1 or a plurality of Ga, Zr, and Hf, the maximum energy product is further increased. Furthermore, it is clear that the crystallized grain diameter and the form of the crystallized grains have a large effect in the reduction of the coercive force temperature coefficient.

TABLE 28

| CLASSIFICATION | | COMPONENT ELEMENTS (ATOMIC %) | | | | | | | | | | |
|---|---|---|---|---|---|---|---|---|---|---|---|---|
| | | | | | TOTAL AMOUNT | | | | TOTAL AMOUNT | | | |
| | | Nd | Co | B | Ga | Zr | Hf | | Al | V | Si | | Fe |
| ANISOTROPIC MAGNETS OF THE PRESENT INVENTION | 110 | 12.5 | 17.4 | 6.0 | 1.0 | — | — | 1.0 | 0.3 | — | — | 0.3 | * |
| | 111 | 12.5 | 17.5 | 6.0 | 1.0 | — | — | 1.0 | 0.1 | 0.1 | — | 0.2 | * |
| | 112 | 12.4 | 17.4 | 5.9 | 1.0 | — | — | 1.0 | — | — | 0.5 | 0.5 | * |
| | 113 | 12.4 | 17.4 | 6.0 | — | 0.1 | — | 0.1 | 0.5 | — | — | 0.5 | * |
| | 114 | 12.3 | 17.4 | 6.0 | — | 0.1 | — | 0.1 | — | 0.3 | — | 0.3 | * |
| | 115 | 12.4 | 17.4 | 6.0 | — | 0.1 | — | 0.1 | — | — | 0.5 | 0.5 | * |
| | 116 | 12.4 | 11.6 | 6.0 | — | — | 0.1 | 0.1 | 1.0 | — | — | 1.0 | * |
| | 117 | 12.5 | 11.6 | 6.0 | — | — | 0.1 | 0.1 | — | 0.2 | 1.2 | 1.4 | * |
| | 118 | 12.5 | 11.6 | 6.0 | — | — | 0.1 | 0.1 | 1.0 | — | 1.0 | 2.0 | * |
| | 119 | 12.5 | 11.6 | 6.0 | 0.5 | 0.1 | — | 0.6 | 0.05 | 0.02 | 0.01 | 0.08 | * |
| COMPARATIVE ANISOTROPIC MAGNETS | 40 | 12.5 | 17.5 | 6.0 | 1.0 | — | — | 1.0 | 3.0※ | — | — | 3.0※ | * |
| | 41 | 12.4 | 17.4 | 6.0 | 1.0 | — | — | 1.0 | — | 3.0※ | — | 3.0※ | * |
| | 42 | 12.5 | 17.5 | 6.0 | 1.0 | — | — | 1.0 | — | — | 3.0※ | 3.0※ | * |

(※INDICATES VALUES WHICH DO NOT FULFILL THE CONDITIONS OF THE PRESENT INVENTION)
*BALANCE

TABLE 29

| CLASSIFICATION | | AVERAGE CRYSTAL GRAIN DIAMETER (μm) | AMOUNT OF CRYSTAL GRAINS PRESENT FOR WHICH THE LARGEST GRAIN DIAMETER/SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|---|
| ANISOTROPIC MAGNETS OF THE PRESENT INVENTION | 110 | 0.3 | 80 | −0.50 | 12.8 | 14.4 | 38.7 |
| | 111 | 0.3 | 90 | −0.50 | 12.9 | 13.7 | 39.5 |
| | 112 | 0.2 | 80 | −0.51 | 12.9 | 14.8 | 39.6 |
| | 113 | 0.5 | 80 | −0.48 | 13.3 | 12.3 | 42.3 |
| | 114 | 0.1 | 100 | −0.49 | 13.3 | 10.1 | 42.2 |
| | 115 | 0.3 | 80 | −0.49 | 13.5 | 12.8 | 43.8 |
| | 116 | 0.3 | 90 | −0.49 | 13.2 | 13.0 | 42.0 |
| | 117 | 0.2 | 90 | −0.50 | 13.3 | 10.7 | 42.2 |
| | 118 | 0.3 | 90 | −0.49 | 13.5 | 12.9 | 43.5 |
| | 119 | 0.3 | 90 | −0.50 | 13.2 | 14.4 | 41.3 |
| COMPARATIVE ANISOTROPIC MAGNETS | 40 | 0.5 | 70 | −0.53 | 11.1 | 12.2 | 23.3 |
| | 41 | 0.8 | 80 | −0.55 | 11.2 | 9.6 | 19.5 |
| | 42 | 0.5 | 70 | −0.53 | 10.9 | 11.3 | 17.0 |

Example of a Fourth Anisotropic Magnet

Next, a fourth anisotropic magnet in accordance with the present invention was produced in the manner detailed hereinbelow, and the characteristics thereof were determined.

Ingots of a R—Fe—Co—B system alloy containing one or a plurality of Ti, V, Nb, Ta, Al, and Si, and ingots of a R—Fe—Co—B system alloy which contained no Ti, V, Nb, Ta, Al, or Si, which were obtained by means of plasma melting and casting, were subjected to homogenizing processing in an atmosphere of argon gas under conditions such that the temperature thereof was 1130° C., and the processing time thereof was 20 hours, and thereafter, these homogenizing processed ingots were crushed to a fineness of approximately 15 mm to form raw material alloys.

The temperature of these raw material alloys was raised from room temperature to 830° C. in an atmosphere of hydrogen gas at a pressure of 1 atmosphere, heat treatment was carried out in an atmosphere of hydrogen gas at a temperature of 830° C. for a period of 1 hour, hydrogen was desorped at a temperature of 830° C. in order to produce a vacuum degree of less than $1\times10^{-1}$ Torr, and immediately thereafter, argon gas was introduced and rapid cooling conducted. After the conclusion of this hydrogen treatment, heat processing was conducted in a vacuum at a temperature of 630° C. for a period of 2 hours. The raw material alloys thus obtained were slightly crushed in mortars, and magnetic powders having a mean particle size of 40 μm were obtained.

These magnetic powders were press formed in a 25 KOe magnetic field to produce green compacts, and each green compact was subjected to hot pressing under conditions such that the temperature thereof was 720° C. and the pressure thereof was 1.5 Ton/cm$^2$, or was subjected to a HIP process under conditions such that the temperature thereof was 710° C. and the pressure thereof was 1.5 Ton/cm$^2$, and furthermore, each melted body was then subjected to heat processing at a temperature of 620° C. for a period of 2 hours. The green compacts which were formed in a magnetic field were arranged and hot pressed in a such a manner that the orientation direction was identical with the pressing direction of the hot pressing.

Among the anisotropic magnets 120–164 of the present invention and the comparative anisotropic magnets 43–56 which were produced in the above manner, anisotropic magnets 120–144 of the present invention and comparative anisotropic magnets 43–49 were produced by means of hot pressing, while anisotropic magnets 145–164 of the present invention and comparative anisotropic magnets 50–56 were produced by means of an HIP method. The density thereof was in all cases sufficiently accurate, being within a range of 7.5–7.6 g/cm$^3$.

Furthermore, for the purposes of comparison, a R—Fe—Co—B system permanent magnetic powder produced from an ingot of an alloy containing no Ti, V, Nb, Ta, Al, or Si was placed in a copper can in a vacuum, this was heated to a temperature of 720° C., and rolling was conducted a number of times so that the rolling ratio reached a value of 80%, and thus a conventional anisotropic magnet 4 was obtained.

The component compositions of the anisotropic magnets 20–164 of the present invention, the comparative anisotropic magnets 43–56, and the conventional anisotropic magnet 4 obtained in the above manner are shown in Tables 30–35. In addition, the average crystallized grain diameter, the amount (volume %) of crystallized grains present having a form in which the value of the ratio of the largest grain diameter/smallest grain diameter is less than 2, the magnetic characteristics, and the coercive force temperature coefficient αiHc of these anisotropic magnets were determined by a method identical to that given above, and the resulting values are shown in Tables 36–40.

From the results of Tables 36–40, it is clear that the R—Fe—Co—B system anisotropic magnets 120–164 of the present invention containing one or a plurality of Ti, V, Nb, Ta, Al, and Si, have essentially identical magnetic characteristics when compared with the conventional anisotropic magnet 4, which does not contain these elements; however, the coercive force temperature coefficient is markedly smaller. Furthermore, when the contained amount of Ti, V, Nb, Ta, Al, and Si lies outside the ranges of the present invention, as in the case of the comparative anisotropic magnets 43–56, the magnetic anisotropy worsens, and it is clear that the crystallized grain diameter and crystallized grain form also have a large influence on the magnetic characteristics.

TABLE 30

| CLASSIFICATION | | COMPONENT ELEMENTS (ATOMIC %) | | | | | | | | | | | | | |
|---|---|---|---|---|---|---|---|---|---|---|---|---|---|---|---|
| | | | | | | | | TOTAL AMOUNT | | | | | | | |
| | | Nd | Tb | Dy | Pr | Co | B | Ti | V | Nb | Ta | Al | Si | | Fe |
| ANISOTROPIC ELEMENTS OF THE PRESENT INVENTION | 120 | 12.0 | — | 0.4 | — | 11.6 | 6.1 | 0.01 | — | — | — | — | — | 0.01 | * |
| | 121 | 12.1 | — | 0.4 | — | 11.6 | 6.0 | 0.1 | — | — | — | — | — | 0.1 | * |
| | 122 | 12.1 | — | 0.4 | — | 11.6 | 6.0 | 0.6 | — | — | — | — | — | 0.6 | * |
| | 123 | 12.1 | — | 0.4 | — | 11.4 | 6.1 | 5.0 | — | — | — | — | — | 5.0 | * |
| | 124 | 12.1 | — | 0.4 | — | 11.5 | 6.1 | — | 0.05 | — | — | — | — | 0.05 | * |
| | 125 | 12.1 | — | 0.4 | — | 11.5 | 6.1 | — | 0.1 | — | — | — | — | 0.1 | * |
| | 126 | 12.0 | — | 0.4 | — | 11.5 | 6.1 | — | 1.0 | — | — | — | — | 1.0 | * |
| | 127 | 12.0 | — | 0.4 | — | 11.6 | 6.1 | — | 4.0 | — | — | — | — | 4.0 | * |
| | 128 | 12.0 | — | — | 0.5 | 11.6 | 6.0 | — | — | 0.01 | — | — | — | 0.01 | * |
| | 129 | 12.0 | — | — | 0.6 | 11.6 | 6.1 | — | — | 0.3 | — | — | — | 0.3 | * |
| | 130 | 12.0 | — | — | 0.5 | 11.5 | 6.0 | — | — | 1.0 | — | — | — | 1.0 | * |
| | 131 | 12.0 | — | — | 0.6 | 11.6 | 6.1 | — | — | 5.0 | — | — | — | 5.0 | * |

*BALANCE

TABLE 31

| CLASSIFICATION | COMPONENT ELEMENTS (ATOMIC %) | | | | | | | | | | | | | |
|---|---|---|---|---|---|---|---|---|---|---|---|---|---|---|
| | | | | | | | TOTAL AMOUNT | | | | | | | |
| | Nd | Tb | Dy | Pr | Co | B | Ti | V | Nb | Ta | Al | Si | | Fe |
| ANISOTROPIC MAGNETS OF THE PRESENT INVENTION | | | | | | | | | | | | | | |
| 132 | 12.2 | 0.2 | — | — | 11.6 | 6.0 | — | — | — | 0.02 | — | — | 0.02 | * |
| 133 | 12.2 | 0.2 | — | — | 11.6 | 5.9 | — | — | — | 0.3 | — | — | 0.3 | * |
| 134 | 12.2 | 0.3 | — | — | 11.6 | 6.1 | — | — | — | 2.3 | — | — | 2.3 | * |
| 135 | 12.1 | 0.3 | — | — | 11.6 | 6.0 | — | — | — | 3.8 | — | — | 3.8 | * |
| 136 | 12.6 | — | — | — | 11.5 | 6.0 | — | — | — | — | 0.01 | — | 0.01 | * |
| 137 | 12.5 | — | — | — | 11.5 | 6.1 | — | — | — | — | 0.5 | — | 0.5 | * |
| 138 | 12.4 | — | — | — | 11.6 | 5.9 | — | — | — | — | 1.0 | — | 1.0 | * |
| 139 | 12.4 | — | — | — | 11.7 | 6.1 | — | — | — | — | 4.9 | — | 4.9 | * |
| 140 | 12.0 | — | — | 0.5 | 11.6 | 6.0 | — | — | — | — | — | 0.04 | 0.04 | * |
| 141 | 12.1 | — | — | 0.4 | 11.6 | 6.0 | — | — | — | — | — | 0.5 | 0.5 | * |
| 142 | 12.1 | — | — | 0.4 | 11.6 | 6.0 | — | — | — | — | — | 1.0 | 1.0 | * |
| 143 | 12.0 | — | — | 0.5 | 11.7 | 6.1 | — | — | — | — | — | 3.6 | 3.6 | * |

*BALANCE

TABLE 32

| CLASSIFICATION | COMPONENT ELEMENTS (ATOMIC %) | | | | | | | | | | | | | |
|---|---|---|---|---|---|---|---|---|---|---|---|---|---|---|
| | | | | | | | TOTAL AMOUNT | | | | | | | |
| | Nd | Tb | Dy | Pr | Co | B | Ti | V | Nb | Ta | Al | Si | | Fe |
| ANISOTROPIC MAGNETS OF THE PRESENT INVENTION | | | | | | | | | | | | | | |
| 144 | 12.3 | — | — | — | 17.4 | 6.5 | — | — | 0.3 | — | — | 1.5 | 1.8 | * |
| 145 | 12.2 | — | — | — | 5.6 | 6.5 | — | — | — | 0.3 | 0.1 | 1.0 | 1.4 | * |
| 146 | 12.3 | — | — | — | 17.3 | 6.4 | — | 0.1 | 0.2 | — | 0.5 | 2.0 | 2.8 | * |
| 147 | 12.3 | — | — | — | 11.6 | 6.4 | 0.2 | — | 0.3 | — | 2.0 | 1.5 | 4.0 | * |
| 148 | 12.3 | — | — | — | 5.8 | 6.5 | 0.1 | — | 0.3 | 0.2 | 2.5 | 1.0 | 4.1 | * |
| 149 | 12.2 | — | — | — | 17.4 | 6.5 | — | — | — | 0.3 | — | 0.5 | 0.8 | * |
| 150 | 12.2 | — | — | — | 11.5 | 6.4 | — | — | 0.1 | 0.3 | 0.2 | 0.2 | 0.8 | * |
| 151 | 12.0 | — | — | 0.4 | 11.5 | 6.5 | — | — | 0.2 | 0.1 | 0.5 | 0.5 | 1.3 | * |
| 152 | 12.0 | — | — | 0.3 | 11.5 | 6.5 | 0.1 | 0.1 | — | — | 0.5 | 0.5 | 1.2 | * |
| 153 | 12.1 | — | — | 0.4 | 11.6 | 6.5 | — | 0.1 | 0.3 | — | 0.3 | 0.5 | 1.2 | * |
| 154 | 11.9 | — | — | 0.4 | 11.6 | 6.4 | 0.1 | 0.1 | 0.1 | 0.1 | 0.1 | 0.1 | 0.6 | * |

*BALANCE

TABLE 33

| CLASSIFICATION | COMPONENT ELEMENTS (ATOMIC %) | | | | | | | | | | | | | |
|---|---|---|---|---|---|---|---|---|---|---|---|---|---|---|
| | | | | | | | TOTAL AMOUNT | | | | | | | |
| | Nd | Tb | Dy | Pr | Co | B | Ti | V | Nb | Ta | Al | Si | | Fe |
| ANISOTROPIC MAGNETS OF THE PRESENT INVENTION | | | | | | | | | | | | | | |
| 155 | 13.0 | — | 0.7 | — | 11.5 | 6.4 | — | — | 0.3 | — | 0.5 | 0.5 | 1.3 | * |
| 156 | 10.0 | — | — | — | 5.8 | 7.0 | — | — | 0.2 | 0.1 | — | 1.0 | 1.3 | * |
| 157 | 14.0 | — | — | — | 11.6 | 7.2 | — | — | 0.2 | 0.1 | — | 1.0 | 1.3 | * |
| 158 | 20.0 | — | — | — | 17.4 | 7.2 | — | — | 0.2 | 0.1 | — | 1.0 | 1.3 | * |
| 159 | 15.5 | — | — | 0.5 | 11.5 | 3.0 | — | — | — | 0.2 | 0.5 | 0.5 | 1.2 | * |
| 160 | 13.5 | — | — | 0.5 | 11.5 | 10.0 | — | — | — | 0.3 | 0.7 | — | 1.0 | * |
| 161 | 14.0 | — | — | 0.5 | 11.5 | 20.0 | — | — | 0.1 | 0.1 | 0.2 | 0.5 | 0.9 | * |
| 162 | 12.0 | 0.5 | — | — | 5.3 | 7.0 | — | — | 0.3 | — | — | 1.0 | 1.3 | * |

*BALANCE

TABLE 34

| CLASSIFICATION | COMPONENT ELEMENTS (ATOMIC %) | | | | | | | | | | | | | |
|---|---|---|---|---|---|---|---|---|---|---|---|---|---|---|
| | | | | | | | TOTAL AMOUNT | | | | | | | |
| | Nd | Tb | Dy | Pr | Co | B | Ti | V | Nb | Ta | Al | Si | | Fe |
| ANISOTROPIC MAGNETS OF PRESENT INVENTION | | | | | | | | | | | | | | |
| 163 | 12.0 | 0.5 | — | — | 30.0 | 7.0 | — | — | 0.3 | — | — | 1.0 | 1.3 | * |
| 164 | 12.0 | 0.5 | — | — | 46.2 | 7.0 | — | — | 0.3 | — | — | 1.0 | 1.3 | * |
| COMPARATIVE ANISOTROPIC MAGNETS | | | | | | | | | | | | | | |
| 43 | 12.2 | — | — | 0.3 | 11.5 | 6.0 | 0.1 | — | 0.1 | — | 0.1 | 0.1 | 0.4 | * |
| 44 | 13.0 | — | 1.5 | — | 11.6 | 7.5 | — | 0.2 | — | 0.2 | — | — | 0.4 | * |
| 45 | 12.2 | — | — | 0.3 | 11.5 | 6.1 | 7.0※ | — | — | — | — | — | 7.0※ | * |
| 46 | 12.2 | — | — | 0.3 | 11.6 | 5.9 | — | 7.0※ | — | — | — | — | 7.0※ | * |
| 47 | 12.1 | — | — | 0.3 | 11.6 | 6.0 | — | — | 7.1※ | — | — | — | 7.1※ | * |
| 48 | 12.2 | — | — | 0.2 | 11.6 | 6.0 | — | — | — | 7.1※ | — | — | 7.1※ | * |
| 49 | 12.1 | — | — | 0.3 | 11.6 | 6.1 | — | — | — | — | 6.5※ | — | 6.5※ | * |

(※INDICATES VALUES WHICH DO NOT FULFILL THE CONDITIONS OF THE PRESENT INVENTION)
*BALANCE

TABLE 35

| CLASSIFICATION | COMPONENT ELEMENTS (ATOMIC %) | | | | | | | | | | | | | |
|---|---|---|---|---|---|---|---|---|---|---|---|---|---|---|
| | | | | | | | TOTAL AMOUNT | | | | | | | |
| | Nd | Tb | Dy | Pr | Co | B | Ti | V | Nb | Ta | Al | Si | | Fe |
| COMPARATIVE ANISOTROPIC MAGNETS | | | | | | | | | | | | | | |
| 50 | 12.2 | — | — | 0.3 | 11.5 | 6.0 | — | — | — | — | — | 7.1 | 7.1 | * |
| 51 | 12.3 | — | — | 0.3 | 11.6 | 6.1 | 2.5 | 2.5 | 2.5 | 2.5 | — | — | 10.0 | * |
| 52 | 9.0 | — | — | — | 11.5 | 7.0 | — | 0.5 | — | 0.5 | — | 0.5 | 1.5 | * |
| 53 | 25.0 | — | — | — | 11.4 | 7.1 | — | — | — | — | 1.0 | 1.0 | 2.0 | * |
| 54 | 12.5 | — | — | — | 52.0 | 7.0 | 2.5 | — | — | — | — | 1.0 | 3.5 | * |
| 55 | 15.5 | — | — | — | 11.3 | 2.0 | — | 0.3 | — | — | 1.0 | — | 1.3 | * |
| 56 | 15.1 | — | — | — | 11.4 | 21.0 | — | 0.3 | — | — | 1.0 | — | 1.3 | * |
| CONVENTIONAL | 14.0 | — | — | — | 11.6 | 7.2 | — | — | — | — | — | — | — | * |

TABLE 35-continued

| CLASSIFICATION | COMPONENT ELEMENTS (ATOMIC %) | | | | | | | | | | | | |
|---|---|---|---|---|---|---|---|---|---|---|---|---|---|
| | | | | | | | TOTAL AMOUNT | | | | | | |
| | Nd | Tb | Dy | Pr | Co | B | Ti | V | Nb | Ta | Al | Si | Fe |
| ANISOTROPIC MAGENT 4 | | | | | | | | | | | | | |

( INDICATES VALUES WHICH DO NOT FULFIL THE CONDITIONS OF THE PRESENT INVENTION)
*BALANCE

TABLE 36

| CLASSIFICATION | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|
| ANISOTROPIC MAGNETS IN ACCORDANCE WITH THE PRESENT INVENTION | | | | | | |
| 120 | 0.5 | 90 | −0.52 | 10.7 | 11.6 | 25.4 |
| 121 | 0.2 | 90 | −0.51 | 11.3 | 11.5 | 28.6 |
| 122 | 0.2 | 100 | −0.49 | 11.9 | 11.0 | 31.5 |
| 123 | 0.1 | 90 | −0.49 | 10.7 | 10.3 | 25.7 |
| 124 | 0.5 | 90 | −0.51 | 10.6 | 12.3 | 25.0 |
| 125 | 0.2 | 80 | −0.49 | 11.4 | 11.8 | 28.3 |
| 126 | 0.3 | 90 | −0.48 | 11.2 | 10.5 | 27.5 |
| 127 | 0.2 | 90 | −0.48 | 10.9 | 10.1 | 25.3 |
| 128 | 0.4 | 90 | −0.51 | 11.8 | 12.5 | 30.0 |
| 129 | 0.3 | 90 | −0.49 | 12.9 | 11.6 | 35.3 |
| 130 | 0.2 | 100 | −0.49 | 12.5 | 11.0 | 33.6 |
| 131 | 0.3 | 80 | −0.48 | 11.0 | 10.3 | 26.1 |
| 132 | 0.2 | 90 | −0.50 | 11.1 | 11.6 | 26.5 |
| 133 | 0.4 | 90 | −0.50 | 12.8 | 11.7 | 36.3 |
| 134 | 0.1 | 80 | −0.51 | 12.0 | 10.2 | 32.2 |

TABLE 37

| CLASSIFICATION | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|
| ANISOTROPIC MAGNETS OF THE PRESENT INVENTION | | | | | | |
| 135 | 0.05 | 80 | −0.48 | 11.3 | 10.1 | 28.1 |
| 136 | 0.3 | 80 | −0.52 | 11.4 | 12.6 | 28.3 |
| 137 | 0.5 | 80 | −0.52 | 12.8 | 14.3 | 36.2 |
| 138 | 0.5 | 60 | −0.52 | 12.0 | 14.0 | 32.2 |
| 139 | 0.5 | 70 | −0.51 | 11.8 | 12.2 | 30.9 |
| 140 | 0.3 | 90 | −0.50 | 11.7 | 12.0 | 30.5 |
| 141 | 0.2 | 100 | −0.49 | 13.0 | 15.1 | 40.1 |
| 142 | 0.1 | 80 | −0.48 | 12.6 | 14.7 | 35.5 |
| 143 | 0.1 | 90 | −0.50 | 12.4 | 13.3 | 34.3 |
| 144 | 0.2 | 90 | −0.49 | 13.1 | 13.0 | 39.5 |
| 145 | 0.2 | 80 | −0.49 | 13.2 | 13.4 | 41.0 |
| 146 | 0.3 | 90 | −0.51 | 11.8 | 12.9 | 32.5 |
| 147 | 0.5 | 100 | −0.50 | 11.7 | 11.6 | 31.6 |
| 148 | 0.3 | 80 | −0.50 | 11.6 | 12.8 | 31.0 |
| 149 | 0.2 | 90 | −0.48 | 13.3 | 13.6 | 41.5 |

TABLE 38

| CLASSIFICATION | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|
| ANISOTROPIC MAGNETS OF THE PRESENT INVENTION | | | | | | |
| 150 | 0.3 | 80 | −0.48 | 13.2 | 13.5 | 40.1 |
| 151 | 0.5 | 70 | −0.50 | 12.8 | 14.0 | 36.4 |
| 152 | 0.2 | 90 | −0.51 | 12.4 | 13.7 | 33.5 |
| 153 | 0.2 | 90 | −0.48 | 13.0 | 13.6 | 38.7 |
| 154 | 0.3 | 90 | −0.51 | 12.6 | 12.7 | 35.0 |
| 155 | 1.0 | 50 | −0.52 | 12.4 | 8.8 | 32.5 |
| 156 | 0.2 | 100 | −0.53 | 11.2 | 9.7 | 26.2 |

TABLE 38-continued

| CLASSIFICATION | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|
| 157 | 0.3 | 90 | −0.51 | 12.6 | 14.2 | 35.1 |
| 158 | 2.0 | 70 | −0.53 | 10.9 | 9.8 | 25.8 |
| 159 | 0.3 | 90 | −0.52 | 10.7 | 8.9 | 24.2 |
| 160 | 1.0 | 80 | −0.50 | 11.8 | 10.4 | 30.2 |
| 161 | 2.0 | 80 | −0.53 | 11.0 | 9.2 | 25.5 |

TABLE 39

| CLASSIFICATION | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|
| ANISOTROPIC MAGNETS OF PRESENT INVENTION | | | | | | |
| 162 | 0.4 | 80 | −0.51 | 12.5 | 13.1 | 33.5 |
| 163 | 0.2 | 60 | −0.47 | 11.6 | 10.6 | 28.5 |
| 164 | 0.2 | 80 | −0.45 | 11.0 | 8.4 | 24.5 |
| COMPARATIVE ANISOTROPIC MAGNETS | | | | | | |
| 43 | 0.01※ | 90 | −0.50 | 9.2 | 3.1 | 5.4 |
| 44 | 22※ | 90 | — | 7.3 | 1.2 | <5 |
| 45 | 0.5 | 80 | −0.52 | 9.7 | 3.4 | 6.0 |
| 46 | 0.3 | 80 | −0.52 | 8.6 | 3.1 | 5.1 |
| 47 | 0.3 | 90 | −0.52 | 9.0 | 3.0 | 5.0 |
| 48 | 0.5 | 90 | — | 8.9 | 2.7 | 5.0 |
| 49 | 0.3 | 80 | −0.52 | 9.1 | 3.3 | 5.8 |

(※INDICATES VALUES WHICH DID NOT FULFILL THE CONDITIONS OF THE PRESENT INVENTION)

TABLE 40

| CLASSIFICATION | AVERAGE CRYSTAL GRAIN DIAMETER (μm) | AMOUNT OF CRYSTAL GRAINS PRESENT FOR WHICH THE LARGEST GRAIN DIAMETER/ SMALLEST GRAIN DIAMETER IS LESS THAN 2 (VOLUME %) | COERCIVE FORCE TEMPERATURE COEFFICIENT αiHc (%/°C.) | MAGNETIC CHARACTERISTICS Br (KG) | iHc (KOe) | BHmax (MGOe) |
|---|---|---|---|---|---|---|
| COMPARATIVE ANISOTROPIC MAGNETS | | | | | | |
| 50 | 1.0 | 80 | −0.53 | 8.0 | 3.4 | <5 |
| 51 | 0.2 | 80 | −0.53 | 9.7 | 3.0 | 5.2 |
| 52 | 1.0 | 80 | — | 7.3 | 0.7 | <5 |
| 53 | 3.0 | 80 | −0.55 | 7.0 | 4.4 | <5 |
| 54 | 2.0 | 70 | — | 8.8 | 2.3 | <5 |
| 55 | 1.0 | 60 | — | 7.3 | 1.0 | <5 |
| 56 | 1.0 | 80 | −0.54 | 6.5 | 3.5 | <5 |
| CONVENTIONAL ANISOTROPIC MAGNET 4 | 0.8 | 40※ | −0.71 | 12.1 | 12.5 | 32.5 |

(※INDICATES VALUES WHICH DO NOT FULFILL THE CONDITIONS OF THE PRESENT INVENTION)

POSSIBILITIES FOR USE IN INDUSTRY

In accordance with the present invention, by means of using a hydrogen treated powder of a R—Fe—B system or a R—Fe—Co—B system containing one or a plurality of Ga, Zr, and Hf, or containing one or a plurality of Ti, V, Nb, Ta, Al, and Si, it is possible to obtain an anisotropic magnet for which the magnetic anisotropy is large, and moreover, the coercive force temperature coefficient is small, so that there is no need to conduct a magnetic anisotropizing process such as a thermoplastic process or the like, as in the conventional method, and production costs can be thereby reduced considerably. Accordingly, the invention contributes greatly to the ability to produce electronic machines such as motors and the like and to improvements in stability.

We claim:

1. A rare earth—Fe—B anisotropic magnet having as main components thereof at least one rare earth element including Y (hereinafter termed "R") and Fe and B, wherein said anisotropic magnet is a hot press molded body or a hot isostatic press molded body (hereinafter termed an "HIP molded body") having a composition comprising R: 10–20 atomic %, B: 3–20 atomic %, and total amount of one or a plurality of Ga, Zr, and Hf: 0.001–5.0 atomic %, the remainder comprising Fe and unavoidable impurities;

said hot press molded body or HIP molded body has an aggregate structure of crystallized grains having as a main phase thereof a $R_2Fe_{14}B$ intermetallic compound having a tetragonal structure, the crystallized grains having dimensions of 0.05–20 μm; and individual crystallized grains comprising more than 50 volume % of total crystallized grains comprising the aggregate structure having a value of less than 2 of a ratio b/a of a smallest grain diameter a and a largest grain diameter b.

2. A rare earth—Fe—B anisotropic magnet having as main components thereof R and Fe and B, wherein R is at least one rare earth element including Y and said anisotropic magnet comprises a hot press molded body or HIP molded body having a composition comprising R: 10–20 atomic %, B: 3–20 atomic %, total amount of one or a plurality of Ga, Zr, and Hf: 0.001–5.0 atomic %, and total amount of one or a plurality of Al, V, and Si: 0.01–2.0 atomic %, the remainder comprising Fe and unavoidable impurities;

the hot press molded body or HIP molded body has an aggregate structure of crystallized grains having as a main phase thereof $R_2Fe_{14}B$ intermetallic compound having a tetragonal structure, the crystallized grains having dimensions of 0.05–20 μm; and individual crystallized grains are present in an amount of more than 50 volume % of total crystallized grains comprising the aggregate structure which have a value of less than 2 of a ratio b/a of a smallest grain diameter a and a largest grain diameter b.

3. A rare earth element—Fe—B anisotropic magnet having as main components thereof R and Fe and B, wherein R is at least one rare earth element including Y and said anisotropic magnet comprises a hot press molded body or HIP molded body having a composition comprising R: 10–20 atomic %, B: 3–20 atomic %, total amount of one or a plurality of Ti, V, Nb, Ta, Al, and Si: 0.001–5.0 atomic %, and the remainder comprising Fe and unavoidable impurities;

the hot press molded body or HIP molded body has an aggregate structure of crystallized grains having as a main phase thereof $R_2Fe_{14}B$ intermetallic compound having a tetragonal structure, the crystallized grains having dimensions of 0.05–20 μm; and individual crystallized grains are present in an amount of more than 50 volume % of the total crystallized grains comprising the aggregate structure which have a value of less than 2 of a ratio b/a of a smallest grain diameter a and a largest grain diameter b.

4. A rare earth—Fe—B anisotropic magnet in accordance with any one of claims 1, 2, or 3, wherein said crystallized grain aggregate structure consists essentially of a $R_2Fe_{14}B$ intermetallic compound.

5. A rare earth—Fe—B anisotropic magnet in accordance with any one of claims 1, 2, or 3, wherein the average crystallized grain diameter is within a range of 0.05–3μm.

6. A rare earth—Fe—Co—B anisotropic magnet having as main components thereof R and Fe and Co and B, wherein R is at least one rare earth element including Y and said anisotropic magnet comprises a hot press molded body or HIP molded body having a composition comprising R: 10–20 atomic %, Co: 0.1–50 atomic %, B: 3–20 atomic %, total amount of one or a plurality of Ga, Zr, and Hf: 0.001–5.0 atomic %, and the remainder comprising Fe and unavoidable impurities;

the hot press molded body or HIP molded body has an aggregate structure of crystallized grains having as a main phase thereof $R_2(Fe, Co)_{14}B$ intermetallic compound having a tetragonal structure, the crystallized grains having dimensions of 0.05–20 μm; and individual crystallized grains are present in an amount of more than 50 volume % of the total crystallized grains comprising the aggregate structure which have a value of less than 2 of a ratio b/a of a smallest grain diameter a and a largest grain diameter b.

7. A rare earth—Fe—Co—B anisotropic magnet having as main components thereof R and Fe and Co and B, wherein R is at least one rare earth element including Y and said anisotropic magnet comprises a hot press molded body or HIP molded body having a composition comprising R: 10–20 atomic %, Co: 0.1–50 atomic %, B: 3–20 atomic %, total amount of one or a plurality of Ga, Zr, and Hf: 0.001–5.0 atomic %, and total amount of one or a plurality of Al, V, and Si: 0.01–2.0 atomic %, the remainder comprising Fe and unavoidable impurities;

the hot press molded body or HIP molded body has an aggregate structure of crystallized grains having as a main phase thereof $R_2(Fe, Co)_{14}B$ intermetallic compound having a tetragonal structure, the crystallized grains having dimensions of 0.05–20 μm; and individual crystallized grains are present in an amount of more than 50 volume % of the total crystallized grains comprising the aggregate structure which have a value of less than 2 of a ratio b/a of a smallest grain diameter a and a largest grain diameter b.

8. A rare earth—Fe—Co—B anisotropic magnet having as main components thereof R and Fe and Co and B, wherein R is at least one rare earth element including Y and said anisotropic magnet comprises a hot press molded body or HIP molded body having a composition comprising R: 10–20 atomic %, Co: 0.1–50 atomic %, B: 3–20 atomic %, and total amount of one or a plurality of Ti, V, Nb, Ta, Al, and Si: 0.001–5.0 atomic %, the remainder comprising Fe and unavoidable impurities;

the hot press molded body or HIP molded body has an aggregate structure of crystallized grains having as a main phase thereof $R_2(Fe, Co)_{14}B$ intermetallic compound having a tetragonal structure, the crystallized grains having dimensions of 0.05–20 μm; and individual crystallized grains are present in an amount of more than 50 volume % of the total crystallized grains comprising the aggregate structure which have a value of less than 2 of a ratio b/a of a smallest grain diameter a and a larger grain diameter b.

9. A rare earth—Fe—Co—B anisotropic magnet in accordance with any one of claims 6, 7, or 8, wherein said crystallized grain aggregate structure consists essentially of a $R_2(Fe, Co)_{14}B$ intermetallic compound.

10. A rare earth—Fe—Co—B anisotropic magnet in accordance with any one of claims 6, 7, or 8, wherein the average crystallized grain diameter is within a range of 0.05–3 μm.

* * * * *

UNITED STATES PATENT AND TRADEMARK OFFICE

CERTIFICATE OF CORRECTION

PATENT NO. : 5,395,462

DATED : March 7, 1995

INVENTOR(S) : Takuo Takeshita, et al.

It is certified that error appears in the above-indentified patent and that said Letters Patent is hereby corrected as shown below:

Column 5, line 53: "Containing" should read --containing--

Column 6, line 6: "0,001" should read --0.001--

Column 13, lines 66-67: "pounders" should read --powders--

Column 20, line 25: "0.4 " should read --0.4--

Column 26, line 47: "7.0" should read --7.0 --

Column 32, line 5: "20" should read --120--

Column 33, lines 61 & 62: "9.0" and "25.0" should read --9.0 -- and --25.0 --

Column 33, line 63: "52.0" should read --52.0 --

Column 34, lines 64 & 65: "2.0" and "21.0" should read --2.0 -- and --21.0 --

Column 34, line 59: "7.1" should read --7.1 --

Column 34, lines 59 & 60: "7.1" and "10.0" should read --7.1 -- and --10.0 --

Signed and Sealed this

Sixteenth Day of April, 1996

Bruce Lehman

*Attest:*

BRUCE LEHMAN

*Attesting Officer*

*Commissioner of Patents and Trademarks*